US007990035B2

(12) United States Patent
Tonomori et al.

(10) Patent No.: US 7,990,035 B2
(45) Date of Patent: Aug. 2, 2011

(54) METAL VAPOR DISCHARGE LAMP WITH A RESTRAIN MEMBER FOR INNER TUBE

(75) Inventors: Rie Tonomori, Nara (JP); Masanori Higashi, Kyoto (JP); Shunsuke Kakisaka, Osaka (JP); Kazuo Takeda, Osaka (JP)

(73) Assignee: Panasonic Corporation, Osaka (JP)

( * ) Notice: Subject to any disclaimer, the term of this patent is extended or adjusted under 35 U.S.C. 154(b) by 366 days.

(21) Appl. No.: 12/279,826

(22) PCT Filed: May 29, 2007

(86) PCT No.: PCT/JP2007/060878
§ 371 (c)(1),
(2), (4) Date: Aug. 18, 2008

(87) PCT Pub. No.: WO2007/139095
PCT Pub. Date: Dec. 6, 2007

(65) Prior Publication Data

US 2010/0219755 A1 Sep. 2, 2010

(30) Foreign Application Priority Data

May 31, 2006 (JP) ..... 2006-152725

(51) Int. Cl.
*H01J 17/16* (2006.01)
*H01J 61/30* (2006.01)

(52) U.S. Cl. ..... 313/238; 313/623; 313/624; 313/625; 313/641; 313/642; 313/643

(58) Field of Classification Search ..... 313/623–625, 313/634–636, 493, 318.12, 570; 118/50; 445/26, 27
See application file for complete search history.

(56) References Cited

U.S. PATENT DOCUMENTS

| | | | | |
|---|---|---|---|---|
| 2,030,392 | A | 2/1936 | Pearce | |
| 2,797,311 | A | 6/1957 | Jurick | |
| 2002/0021093 | A1 * | 2/2002 | Kakisaka et al. | 313/634 |
| 2005/0127807 | A1 | 6/2005 | Arndt et al. | |

FOREIGN PATENT DOCUMENTS

| | | |
|---|---|---|
| EP | 1 763 066 | 3/2007 |
| GB | 750863 | 6/1956 |
| JP | 8-236087 | 9/1996 |
| JP | 11-96973 | 4/1999 |
| JP | 2005-174936 | 6/2005 |
| NL | 750863 | 6/1956 |
| WO | 2006/001166 | 1/2006 |

OTHER PUBLICATIONS

Asao, Minoru, Japanese Patent Publication 08-236087,Sep. 1996, machine translation.*

* cited by examiner

*Primary Examiner* — Anne Hines
*Assistant Examiner* — Tracie Green

(57) ABSTRACT

With regard to a metal vapor discharge lamp with a triple tube structure including a discharge tube, an inner tube, and an outer tube, misalignment of axes of the inner tube and the outer tube is prevented. The metal vapor discharge lamp (14) is composed of a discharge tube (30) having a pair of electrodes therein, an inner tube (32) having a pinch-sealed part (86) at an end thereof and hermitically housing the discharge tube therein, and an outer tube (34) housing the inner tube therein, and a base (36). In a clearance between the inner tube and the outer tube, there disposed a restrain member (37) for restraining movement of the inner tube relative to the outer tube in a direction orthogonal to an axis of the metal vapor discharge lamp.

19 Claims, 28 Drawing Sheets

37

160

METAL VAPOR DISCHARGE LAMP WITH A RESTRAIN MEMBER FOR INNER TUBE

TECHNICAL FIELD

The present invention relates to a metal vapor discharge lamp and a lighting fixture.

BACKGROUND ART

Metal vapor discharge lamps of high luminance, high efficiency and long life, such as a metal halide lamp (hereinafter, simply referred to as "lamp"), have been widely used in many places for the above features.

A conventional lighting fixture that uses the above lamp as a light source includes, in addition to the lamp, a reflector that has a concave reflecting surface that reflects light emitted from the lamp in a desired direction. The reflector's light output opening is covered with, for example, a front glass plate (what is called a closed type lighting fixture). Note that the reason for covering the light output opening is to prevent broken pieces of the lamp from scattering outside of the lighting fixture when the lamp (discharge tube) is broken for some reasons.

Recently, there has been a demand for so-called an open type lighting fixture that is a conventional lighting fixture whose light output opening is not covered with a front glass. To meet such a demand, a lamp with the following structure is suggested. For example, the lamp is composed of a discharge tube, an inner tube and an outer tube, which is so-called a triple-tube structure. The inner tube houses the discharge tube, and the outer tube houses the inner tube. If the inner tube is damaged because of the breakage of the discharge tube, broken pieces of the inner tube remain within the outer tube. (e.g. Patent Document 1).

Note that each of the inner and outer tubes of the lamp has a tubular shape whose one end is open and another end is closed. The discharge tube is housed in the inner tube of which the other end is pinch-sealed. In addition, the outer circumference of the other end of the inner tube is bonded to the inner circumference of the other end of the outer tube with use of an adhesive (e.g. cement).

Patent Document 1: Japan Unexamined Patent Publication No. H11-96973

DISCLOSURE OF THE INVENTION

Problems the Invention is Attempting to Solve

As a result of actually producing lamps with the above triple-tube structure, it is that many of the lamps have the central axed of the inner tube and the outer tube that are out of alignment and away from each other. When the central axes of the inner tube and the outer tube are too far from each other, the following problem occurs. When the lamp is mounted on the reflector, the discharge center of the discharge tube is not on the optical axis of the reflecting surface, which results in decrease in luminance of the lighting fixture and dispersion of light distribution of each lamp.

The present invention is made in view of the above problems. It is an object of the present invention to provide a metal vapor discharge lamp and a lighting fixture where the misalignment of the central axes of the inner tube and the outer tube is prevented by a simple structure.

Means for Solving the Problems

To achieve the above object, the present invention provides a metal vapor discharge lamp including: a discharge tube; an inner tube provided in the outer tube and fixed to a base by a sealed end of the inner tube; a discharge tube provided with a pair of electrodes and housed in the inner tube; a power supplier electrically connected to the electrodes and housed in the inner tube; and a restrain member that restrains the inner tube from moving and that is provided in a clearance between the inner tube and the outer tube, wherein the restrain member has an annular part that is extended in a direction orthogonal to a central axis of the inner tube and a supporting part that is extended from the annular part and that is approximately parallel to the central axis of the inner tube.

With this structure, since the restrain member is provided between the inner tube and the outer tube, the restrain member reduces a moving distance of the inner tube in the direction orthogonal to the central axis and also reduces a moving distance of the inner tube in the direction of the lamp axis direction, when, for example, the inner tube is received (inserted) in the outer tube.

The number of the restrain member is not specifically limited, and accordingly there may be one restrain member or more. When the inner tube moves in the direction orthogonal to the central axis, the restrain member may be configured to be in contact with the inner tube so as to restrain the movement of the inner tube. Alternatively, the restrain member may be configured to be in contact with the inner tube so as to originally restrain the movement of the inner tube.

It is a characteristic of the restrain member that the restrain member is circumferentially in contact with at least one of an inner circumferential surface of the outer tube and an outer circumferential surface of the inner tube at least at three points.

"Contact with . . . at least at three points" means the concept including the following cases. For example, when the restrain member is composed of three members, each member is in contact with the circumferential surface at one point. Another example is when the restrain member is composed of two members, a surface of each member is in contact with its corresponding circumferential surface.

On the other hand, the lighting fixture in accordance with the present invention has a metal vapor discharge lamp and a reflector that reflects light emitted from the metal vapor discharge lamp in a desired direction. The metal vapor discharge lamp is characterized by a metal vapor discharge lamp having the above structure.

Effects of the Invention

The metal vapor discharge lamp in accordance with the present invention has a restrain member that reduces a moving distance of the inner tube in a direction orthogonal to the central axis of the inner tube. Thus, the restrain member is able to prevent the misalignment between the central axes of the inner tube and the outer tube.

The lighting fixture of the present invention is provided with the metal vapor discharge lamp in which there is little misalignment between the central axes of the inner tube and the outer tube, which prevents the misalignment between the optical axis of the reflector and the discharge center of the lamp.

REFERENCE NUMERALS

Figure 1:
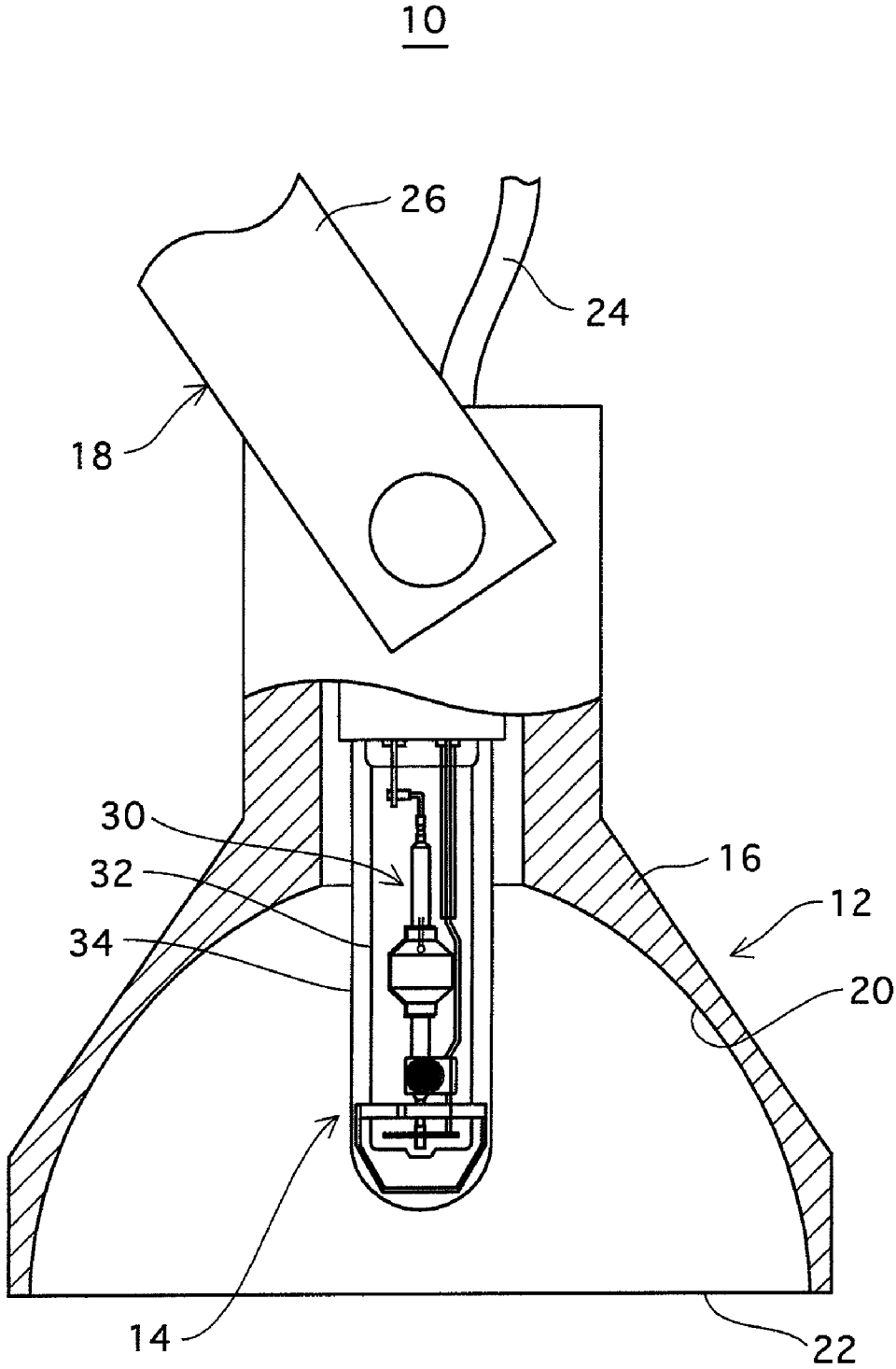
FIG. 1 is an overall view of a lighting fixture in accordance with an embodiment of the present invention, the view being partially cut out to show the inside of a reflector.

10 lighting fixture
12 lighting apparatus
14 metal halide lamp
16 reflector
30 discharge tube
32 inner tube
34 outer tube
36 base
37 restrain member

BEST MODE FOR CARRYING OUT THE INVENTION

The following describes a lighting fixture in accordance with an embodiment of the present invention, and a lamp that is used as a light source of the lighting fixture, with reference to the attached figures.

1. Lighting Fixture

FIG. 1 is an overall view of the lighting fixture in accordance with the embodiment. The view is partially cut out to show the inside of a reflector.

As shown in FIG. 1, a lighting fixture 10 is composed of a lighting apparatus 12 and a lamp 14 that is mounted on the lighting apparatus 12. Although the lighting apparatus 12 is for spotlighting, the lighting fixture of the present invention can be applied to other purposes as well.

The lighting apparatus 12 includes a reflector 16 that reflects, in a forward direction, light emitted from the lamp 14 placed therein, a socket (unshown) which is mounted inside the reflector 16 and to which the lamp 14 is attached, and an attachment 18 that fix the reflector 16 to a wall or a ceiling.

As shown in FIG. 1, the reflector 16 has a concave reflecting surface 20. This reflecting surface 20 is made of, for example, alumina glass. Note that the reflector 16 is so-called a (forwardly) open type reflector whose opening 22 (light output opening) is not covered with a glass plate or the like. Note that a lighting fixture that uses an open type reflector is also called an open type lighting fixture.

The socket is electrically connected to a base of the lamp 14 and supplies the lamp 14 with electricity. Note that a ballast (unshown) to light the lamp 14 is fixed on, for example, the ceiling, such as being embedded in the ceiling, and supplies electricity to the lamp 14 via a power supplier 24 that is described later.

The attachment 18 is, for example, in a shape of the letter "U," and includes a pair of arms 26 (,26) that are arranged in parallel to each other and a connection part (unshown) that connects the pair of the arms 26 (,26). The axis of the reflector 16 is rotatably fixed by being sandwiched by the pair of the arms 26 (,26). The connection part is attached to, for example, the wall or the ceiling. Note that a direction of the light radiated from the lighting fixture 10 can be adjusted by rotating the attachment 18 that is rotatably fixed to the reflector 16.

2. Lamp.

Figure 2:
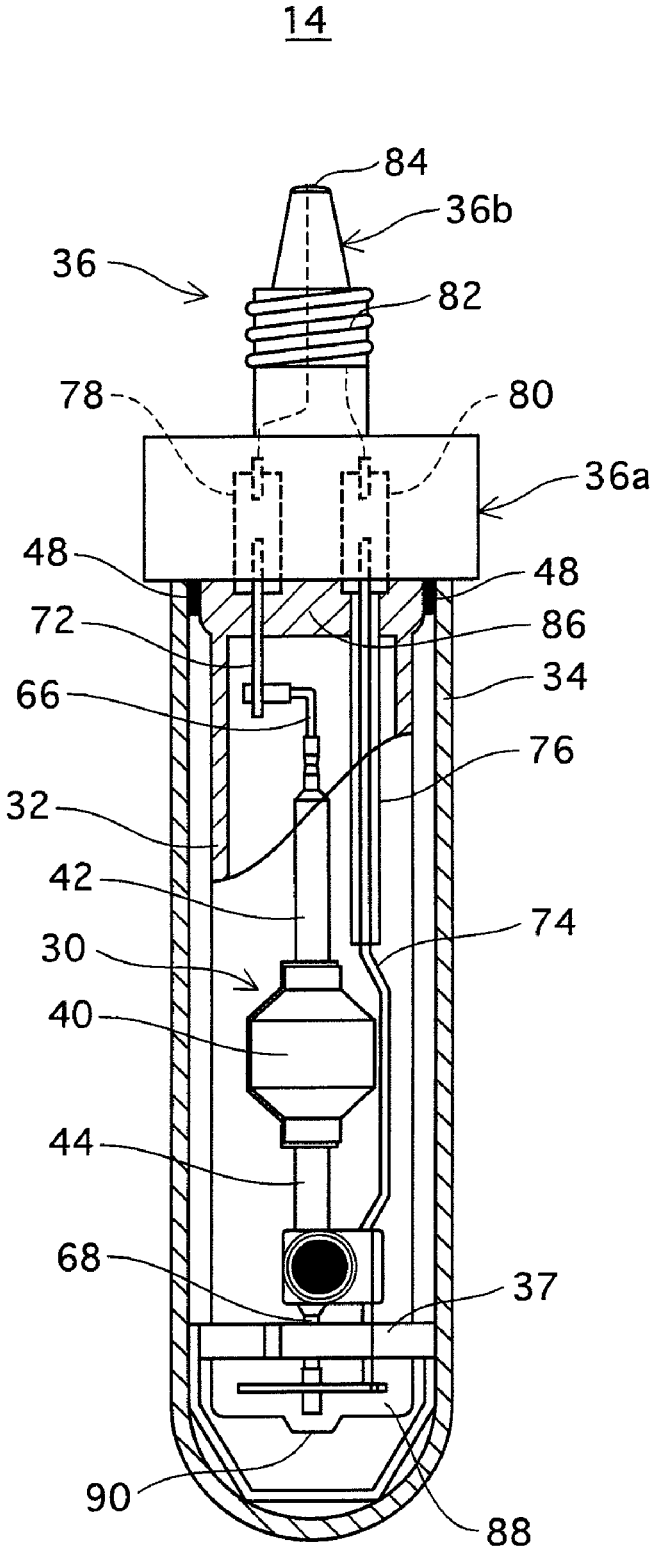
FIG. 2 is an elevational view of a lamp in accordance with the embodiment of the present invention.

FIG. 2 is an elevational view of the lamp 14 in accordance with the embodiment.

The lamp 14 has a triple-tube structure, with a discharge tube 30 having a pair of electrodes and a discharge spade formed therein, an inner tube 32 that is an airtight envelope housing the discharge tube 30, and an outer tube 34 that is a protective envelope housing the inner tube 32. The lamp 14 further includes a base 36 that receives power from the socket of the lighting apparatus 12, and a restrain member 37 disposed between the inner tube 32 and the outer tube 34 at an opposite end to the base 36.

Note that in a case where the discharge tube is broken for some reason, and consequently the broken pieces damage the inner tube 32, since the lamp 14 includes the outer tube 34, the broken pieces of the discharge tube 30 remain within the outer tube 34.

Figure 3:
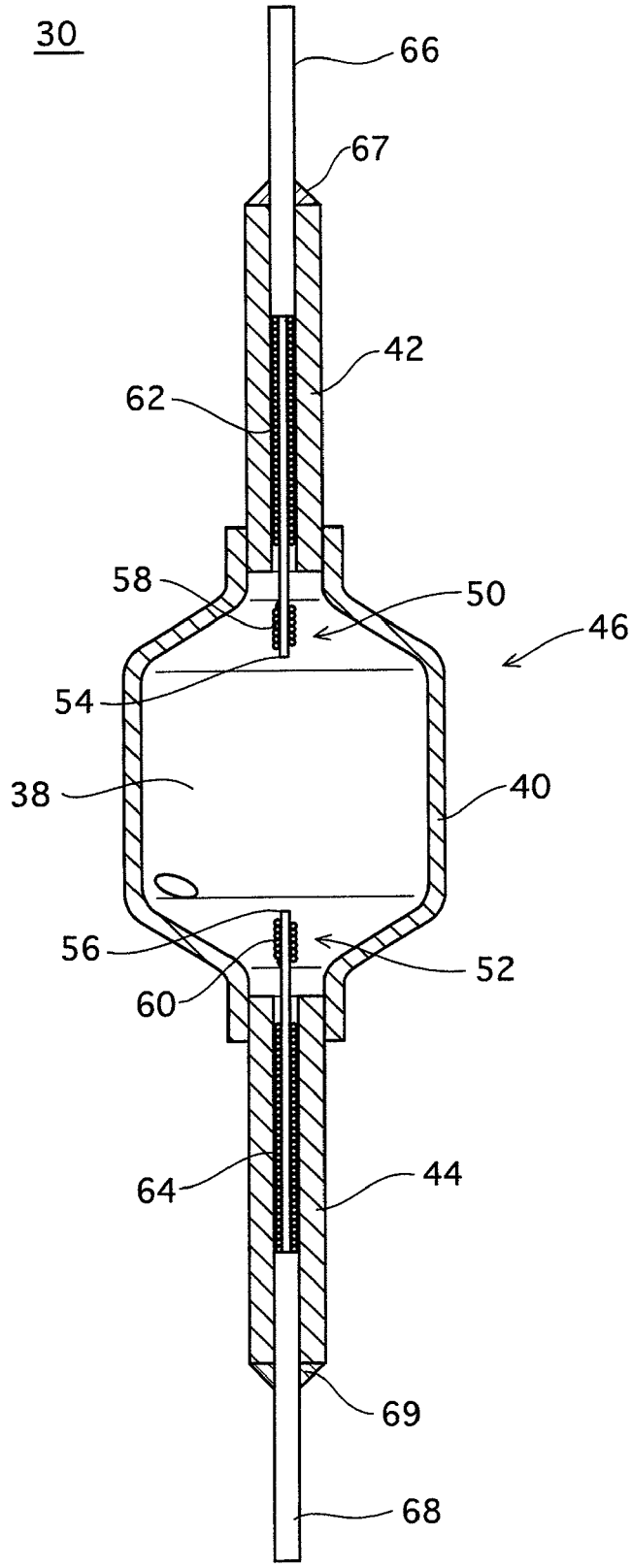
FIG. 3 is an elevational sectional view of a discharge tube.

FIG. 3 is an elevational sectional view of the discharge tube 30.

The discharge tube 30 includes a main tube part 40 that has an airtight discharge space 38 therein and thin tube parts 42 and 44 each extending outwardly in the axial direction of the main tube part 40. The main tube part 40 and the thin tube parts 42 and 44 are made of transparent ceramic materials, such as alumina ceramics. Note that the main tube part 40 and the thin tube parts 42 and 44 may be made of other ceramics, quartz glass or the like.

The main tube part 40 is provided with a pair of electrodes 50 and 52 inside the discharge space 38. The electrodes 50 and 52 approximately oppose each other on the central axis in the longitudinal direction of the lamp 14 (hereinafter, simply referred to as "lamp axis"), or on a parallel axis to the lamp axis. In addition, within the discharge space 38, given amounts of metal halide that is a luminous material, a rare gas that aids start of the lighting, mercury that is a buffer gas are enclosed. As the metal halide, for example, sodium iodide, dysprosium iodide, and the like are used. Note that the metal halide for the use depends on a luminous color of the lamp 14.

As shown in FIG. 3, the electrodes 50 and 52 include electrode rods 54 and 56, and electrode coils 58 and 60 respectively. The electrode coils 58 and 60 are disposed at ends (toward the discharge space 38) of the electrode rods 54 and 56, respectively. Note that in clearances between the electrode rods 54 and 56 and the thin tube parts 42 and 44, molybdenum coils 62 and 64 wound around the electrode rods 54 and 56 are inserted so as to prevent invasion of the luminous material.

Note that as described above, ideally (in a plan), the electrodes 50 and 52 are approximately opposed to each other on the lamp axis, which is to say, the central axes of the electrode rods 54 and 56 are arranged approximately on the lamp axis. However, actually according to the accuracy of the process, the central axes may not be on the lamp axis.

Power feeders 66 and 68 whose ends are connected to the electrodes 50 and 52, respectively, are inserted to the thin tube parts 42 and 44 respectively. The power feeders 66 and 68 are respectively sealed with sealing members 67 and 69 that are made of frit poured into the thin tube part 42 and 44 from the opposite end to the main tube part 40. Note that parts of the sealing members 67 and 69 shown in FIGS. 2 and 3 are the frit running out from the ends of the thin tube parts 42 and 44.

The description of the lamp 14 is made again.

As shown in FIG. 2, one end of the power feeder 66 opposite to the electrode 50 is electrically connected to a power supplier 72. Similarly, one end of the power feeder 68 opposite to the electrode 52 is electrically connected to a power supplier 74. The power suppliers 72 and 74 are electrically connected to a shell 82 and an eyelet 84, respectively, of the base 36 via metal foils 78 and 80, and such.

A part of the power supplier 74 toward the base 36, which is, for example, the area facing the power supplier 72 and the power feeder 66 connected thereto is covered with a sleeve 76 made of, for example, quartz glass.

As shown in FIG. 2, the above-mentioned discharge tube 30 and the like are housed in the inner tube 32 that is in a tubular shape such as a cylinder. The inner tube 32 is made of, for example, quartz glass. One end of the inner tube 14 that is in the vicinity of the metal foils 78 and 80 is pinched flatly with use of so-called pinch sealing, and accordingly the inner tube 32 is sealed airtight around the metal foils 78 and 80.

Thus, the inner tube 32 is an airtight envelope whose one end is sealed. The pinched and sealed end of the inner tube 32 is called a pinch-sealed part 86.

A protrusion 90 part present at another end of the inner tube 32 is a tip-off part that is a remnant of an exhaust pipe having been used for evacuating atmosphere from the inner tube 32. The inner tube 32 is evacuated in order to prevent oxidation of metal members such as the power feeders 66 and 68, the power suppliers 72 and 74 and the like that are exposed to high temperatures during the operation of the lamp. In view of the prevention of the oxidation, instead of the evacuation, the inside of the inner tube 32 (and also the outside of the discharge tube 30) may be filled with an inert gas.

The inner tube 32 is covered with the outer tube 34 in a bottomed tubular shape (which is a tube having one open end and one closed end) as shown in FIGS. 2 and 3. The outer tube 34 is made of hard glass, for example, and serves as a protective tube. More specifically, when the discharge tube 30 is broken and the inner tube 32 is damaged, the outer tube 34 serves to prevent pieces of broken glass and such from scattering.

As with the inner tube 32, the outer tube 34 is in a tubular shape such as a cylinder in order to make the lamp compact. The distance between the outer tube 34 and the inner tube 32 is 1 mm-2 mm on average in order to keep the clearance between the outer tube 34 and the inner tube 32 so that the outer tube 34 can receive the inner tube 32 in the assembling process.

As shown in FIG. 2, the restrain member 37 is disposed at a top end of the outer tube 34 that is opposite to the base 36. Before the discharge tube 30, the inner tube 32, the outer tube 34 and such are assembled together, this restrain member 37 has been inserted into the outer tube 34 in advance. Then, as the inner tube 32 is being inserted into the outer tube 34, the restrain member 37 disposed inside the outer tube 34 is expanded in a radial direction of the inner tube 32. Consequently, the restrain member 37 comes in contact with the inner circumferential surface of the outer tube 34.

Figure 4:
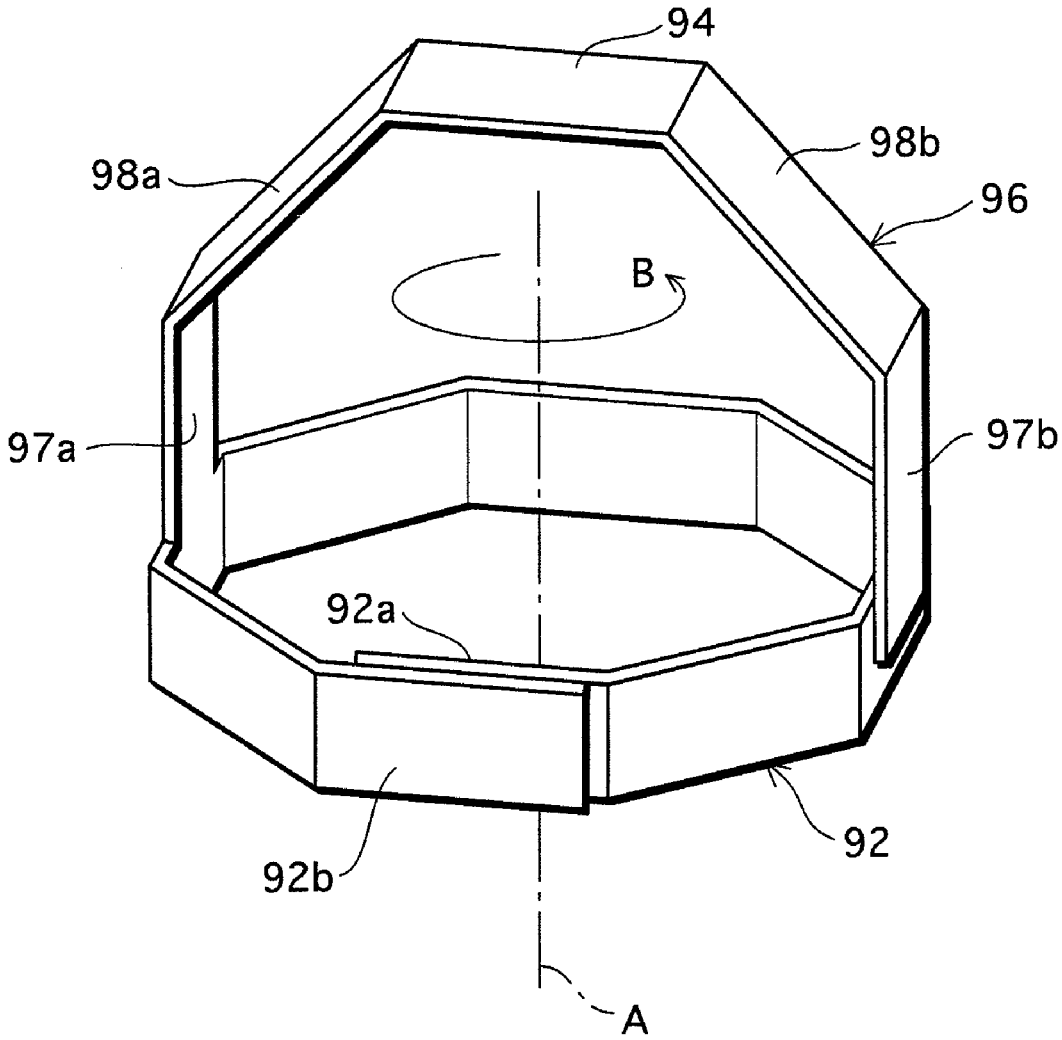
FIG. 4 is a perspective view of a restrain member.

FIG. 4 is a perspective view of the restrain member 37.

The restrain member 37 includes an annular part 92 and a supporting part. The annular part 92 includes end parts **92*a* and 92*b* overlapped with each other in a circumferential direction (e.g. in a direction of the arrow B), and is formed in an annular shape whose diameter is smaller than the outside diameter of the inner tube 34. The supporting part supports the annular part 92 so that the annular part 92** does not move in an extension direction of the lamp axis (this direction is referred to as the "lamp axis direction").

The supporting part includes a U-shaped part 96 formed approximately in a shape of the letter "U." The U-shaped part 96 extends in a direction to which a central axis A of the annular part 92 extends (hereinafter, referred to as the "central axis direction"), and at some point of the extension, the U-shaped part 96 is curved (bent) toward the central axis A. The U-shaped part **96*a* includes a flat part 94** extending perpendicularly to the central axis A.

As described above, the annular part 92 is formed in an annular shape with end parts **92*a* and 92*b* being overlapped with each other. Hence, when the inner tube 32 is inserted into the annular part 92, the end parts 92***a* and 92*b* are circumferentially moved away from each other. Thus, the annular part 92 is radially expanded.

In short, the annular part 92 has a function of being expanded in a radial direction from the center thereof corresponding to the central axis of the inner tube 34 and the outer tube 36 (corresponding to the central axis A of the annular part 92). This radial expansion function can be achieved as follows. One plate-like member that is longer than the outer circumference of the inner tube 34 is curved (bent) in an annular shape, such as a polygon (octagon) with the end parts (corresponding "92*a*, 92*b*" of FIG. 4) being overlapped.

As shown in FIG. 4, the U-shaped part 96 has a pair of extension parts 97*a* and 97*b* extending in an extension direction of the central axis (A) of the annular part 92 (hereinafter, referred to as the "central axis direction"), a pair of slope parts 98*a* and 98*b* extending from opposite ends of the extension parts 97*a* and 97*b* to the annular part 92 and sloping toward the central axis (A), and a flat part 94 present between opposite ends of the slope parts 98*a* and 98*b* to the extension parts 97*a* and 97*b*.

Note that the extension part 97*b* not extending from but reaching the annular part 92 is merely in contact with or adjacent to the annular part 92. Thus, the extension part 97*b* is not joined to the annular part 92.

The lengths and the like of the extension parts 97*a* and 97*b* and the slope parts 98*a* and 98*b* of the U-shaped part 96 are determined so that the flat part 94 is located at a given position within the outer tube 34. That is to say, the extension parts 97*a* and 97*b* and the slope parts 98*a* and 98*b* of the U-shaped part 96 are structured as follows. When the inner tube 32 is inserted into the outer tube 34, the top end (corresponding to a part not influenced by radiation of light emitted from the discharge tube) of the inner tube 32 comes to a position where the top end is fitted into the annular part 92.

Note that, as shown in FIG. 2, the outer tube 34 and the inner tube 32 are bonded together with an adhesive, for example, cement 48. The inside of the outer tube 34 may be decompressed or filled with an inert gas. Furthermore, the inside of the outer tube 34 may communicate with the outside of the outer tube 32, which is to say, the outer tube 34 may be exposed to the atmosphere.

3. Method for Manufacturing Lamp

The lamp 14 with the above structure is produced through an assembling process and a base-attaching process. In the assembling process, the inner tube 32 (having a sealing part 86) housing the discharge tube 30 therein, the restrain member 37 and the outer tube 34 are assembled. In the base-attaching process, the base 36 is attached to the end of the assembled outer tube 34.

Note that the base-attaching process is not described in this description, because the base-attaching process is performed with use of a conventional method that is publicly known.

Figure 5:
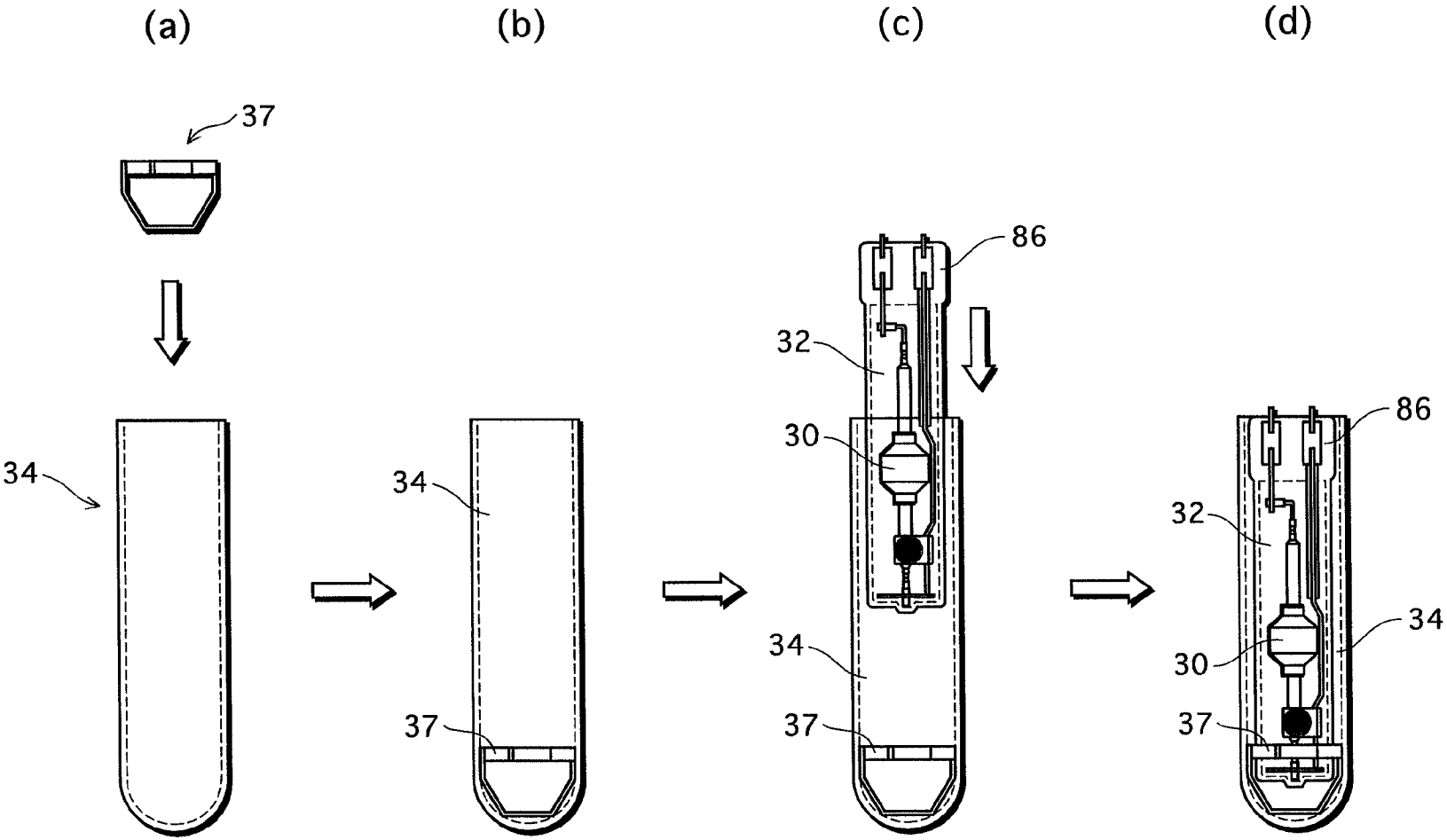
FIGS. 5A, 5B, 5C and 5D are views showing a process for assembling the lamp.

FIG. 5 is a view showing a process for assembling the lamp.

In the assembling process, as shown in FIG. 5A, the outer tube 34 and the restrain member 37 are prepared. Subsequently, as shown in FIG. 5B, the restrain member 37 is inserted into the outer tube 34 until the restrain member 37 reaches the bottom (corresponding a lower end of the outer tube when the open end of the outer tube faces upward) of the outer tube 34.

Subsequently, the inner tube 32 which houses the discharge tube 30 therein and of which one end is sealed is prepared. As shown in FIG. 5*a*, the inner tube 32 is inserted into the outer tube 34 from the opposite end thereof to the sealed part 86.

Subsequently, the inserted end of the inner tube 32 reaches the annular part 92 of the restrain member 37. When the inner tube 32 is further inserted, the annular part 92 is radially expanded in association with the insertion, which allows the inner tube 32 to be even further inserted and the outer circumference surface of the annular part 92 to be in contact with the inner surface of the outer tube 34.

After completion of the insertion of the inner tube 32 into the outer tube 34 (shown in FIG. 5D), the inner tube 32 and the outer tube 34 are bonded together with use of the cement 48, with this insertion position being kept. Thus, the assembling process is completed.

In this state, since the restrain member 37 lies between the inner tube 32 and the outer tube 34 at the top ends thereof, the top ends of the inner tube 32 and the outer tube 34 cannot be out of alignment. This prevents the tube axes of the inner tube 32 and the outer tube 34 from being largely displaced from each other. This also prevents forming a large angle between the tube axes of the inner tube 32 and the outer tube 34.

Before the inner tube 32 is inserted into the outer tube 34, the restrain member 37 with the above simple structure is inserted into the outer tube 34. Subsequently, the inner tube 32 is inserted into the outer tube 34. Thus, the present invention is easily implemented and, furthermore, prevents the misalignment between the tube axes of the inner tube 32 and the outer tube 34.

As the inner tube 32 is inserted, the annular part 92 of the restrain member 37 is radially expanded. Accordingly, the outer circumference of the annular part 92 is in contact with the outer tube 34, which fixes the outer tube 32 and the inner tube 34 more firmly. That is to say, while the inner tube 32 and the outer tube 34 are bonded solely with the cement 48 in a conventional lamp, in the lamp 14 of the embodiment, the inner tube 32 and the outer tube 34 are not only bonded with the cement 48 but also secured by the bonding structure in which the restrain member 37 presses against the outer tube 34. Thus, the inner tube 32 and the outer tube 34 are more firmly bonded, which results in increase in the reliability and the like with regard to the bonding. Accordingly, for example, the outer tube 34 is prevented from falling from the inner tube 32.

In the restrain member 37, the annular part 92 and the U-shaped part 96 are connected with each other. This U-shaped part 96 disposed between the top ends of the inner tube 32 and the outer tube 34 prevents, for example, the annular part 92 from moving toward the axial direction of the inner tube 32 (toward the center of the inner tube 32) due to shake and the like during transportation. Note that merely for the sake of preventing the misalignment between the axes of the inner tube 32 and the outer tube 34, the annular part 92 alone provides sufficient benefit.

Furthermore, the flat part 94 of the U-shaped part 96 is located between the top end of the inner tube 92 (a tip-off part 90) and the outer tube 34. Consequently, even if the discharge tube 30 is broken for some reason, and broken pieces of the tip-off part 90 of the inner tube 92 scatter, the broken pieces are prevented from directly colliding with the outer tube 34.

According to the inventors' investigation, the following is turned out. The inventors manufactured lamps each having a restrain member attached thereto without the U-shaped part 96. As a result of forcedly breaking their discharge tubes, three out of ten lamps show breakage of their outer tubes (more specifically, the outer tube got holes) due to the scatter of broken pieces of their tip-off parts.

Accordingly, even when the discharge tube 30 is broken, the tip-off part 90 covered with the flat part 94 prevents the breakage of the outer tube 34 due to the scatter of the tip-off part 90 of the inner tube 32.

Note that, conventionally, since both tube axes of the inner tube 32 and the outer tube 34 are out of alignment, the following base attaching process is performed where the base 36 is fixed after the inner tube 32 and the outer tube 34 are bonded together with the cement 48. However, since the restrain member 37 prevents the misalignment between the tube axes of the inner tube 32 and the outer tube 34, the inner tube 32 and the outer tube 34 can be bonded with the cement simultaneously with the inner tube 32 and the outer tube 34 being fixed to the base 36.

During the operation of the lamp 14 of the embodiment, the temperature of the discharge lamp 30 rises. The end parts 92*a* and 92*b* of the annular part 92 are overlapped to be circumferentially movable, without being fixed to each other. When the rise in the temperature of the discharge tube 30 causes expansion of the inner tube 32 and the outer tube 34, since the end parts 92*a* and 92*b* are not fixed to each other, even when the expansion coefficients of the inner tube 32 and the outer tube 34 are different from each other, the difference does not cause the breakage of the inner tube 32 or the outer tube 34.

<Modification>

Up to this point, the present invention is described based on the above embodiment. The present invention is never limited to the specific examples shown in the embodiment, and the following modifications can be made.

1. Restrain Member (1) Structure a. Annular Part

In the restrain member 37 described in the above embodiment, the end parts 92*a* and 92*b* of the annular part 92 are overlapped with each other in the circumferential direction, and the annular part 92 is longer than one turn around the central axis A. However, the end parts of an annular part do not need to be overlapped with each other. The following describes a modification where end parts of a restrain member are not overlapped with each other. Note that a part whose end parts are not overlapped with each other in the circumferential direction and whose plate-like member is bent in a shape of the letter "C" is also considered to be in an annular shape. Note also that the shape of the letter "C" includes a shape curved in an arc and a shape bent in a multangular shape.

Figure 6:
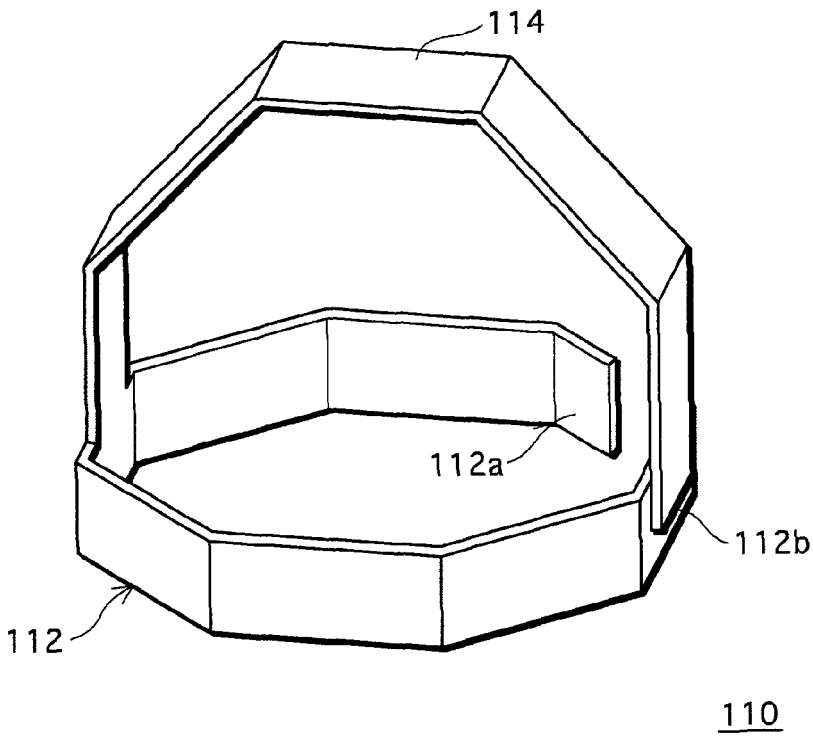
FIG. 6 is a view of a restrain member in accordance with a modification 1.

FIG. 6 is a view of a restrain member in accordance with a modification 1.

As shown in FIG. 6, a restrain member 110 in accordance with a modification 1 has an annular part 112 and a U-shaped part 114. The annular part 112 has end parts 112*a* and 112*b* not being overlapped with each other but being separate from each other in the circumferential direction. Note that the U-shaped part 114 has a basically identical structure with that of the U-shaped part 96 of the embodiment.

The annular part 112 is in an annular shape forming an approximately octagon, as with the annular part 92 of the embodiment. The diameter of the inner circumference of the annular shape is smaller than that of the outer circumference of the inner tube 32. Thus, the insertion of the inner tube 32 radially expands the annular part 112, and the reaction to the expansion tightens up the inner tube 32.

Figure 7:
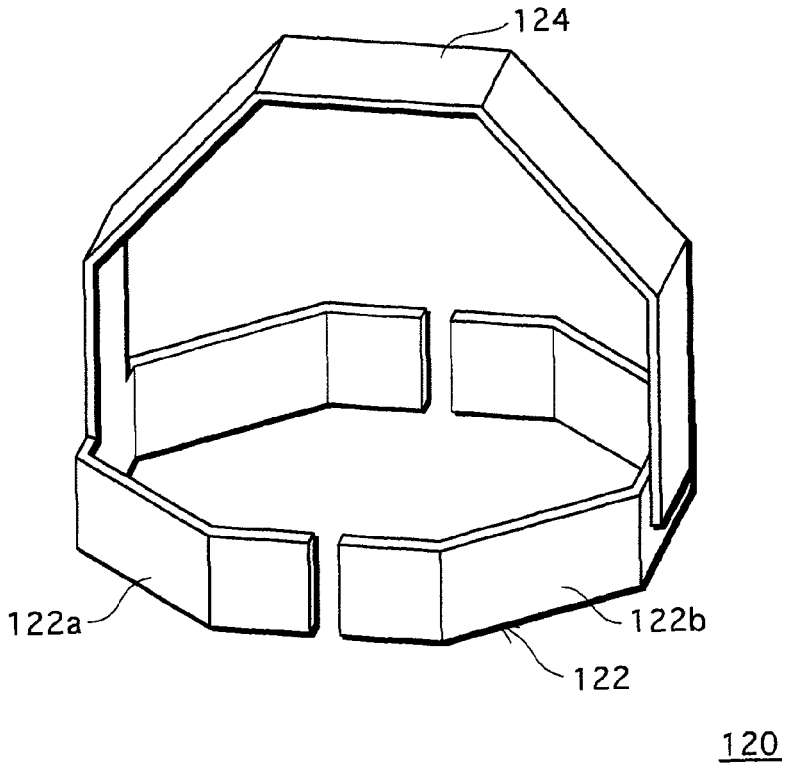
FIG. 7 is a view of a restrain member in accordance with a modification 2.

FIG. 7 is a view of a restrain member in accordance with a modification 2.

As shown in FIG. 7, a restrain member 120 in accordance with the modification 2 has an annular part 122 and a U-shaped part 124. The annular part 122 is composed of a pair of C-shaped parts 122*a* and 122*b* whose respective openings oppose each other. The U-shaped part 124 is in a shape of the letter "U" for connecting the C-shaped parts 122*a* and 122*b*.

The U-shaped part 124 is fixed to the C-shaped parts 122*a* and 122*b*. This U-shaped part 124 is made of a material deformable in a direction in which the C-shaped parts 122*a* and 122*b* approaches to or separate from each other.

The pair of the C-shaped parts 122*a* and 122*b* is disposed such that the ends thereof are spaced. The diameter of an inner circumference of an annular shape defined by the pair of the C-shaped parts 122*a* and 122*b* is smaller than the diameter of an outer circumference of the inner tube 32. Thus, when the inner tube 32 is inserted into the annular part 122 composed of the pair of the C-shaped parts 122*a* and 122*b*, the annular part 122 is radially expanded, and the reaction to the expansion tightens up the inner tube 32.

Note that it does not matter whether the C-shaped parts 112*a* and 112*b* are deformable in a direction in which a distance between the ends of the opening of each C-shape part is increased. However, if the C-shaped parts 112*a* and 112*b* are made of an elastically deformable material, the inner tube is effectively tightened.

b. Supporting Part

The supporting part (U-shaped part 96) described in the embodiment is in a shape of the letter "U" and includes the flat part 94. However, the supporting part may be in any shape as long as the annular part is supported in such a manner that the insertion of the inner tube does not displace the annular part having been disposed within the outer tube (if displaced, the annular part is not fitted over the outer circumference of the inner tube) in the insertion direction of the inner tube (direction opposite to the base of the outer tube).

The following describes modifications of the supporting part each having a different structure (shape).

Figure 8:
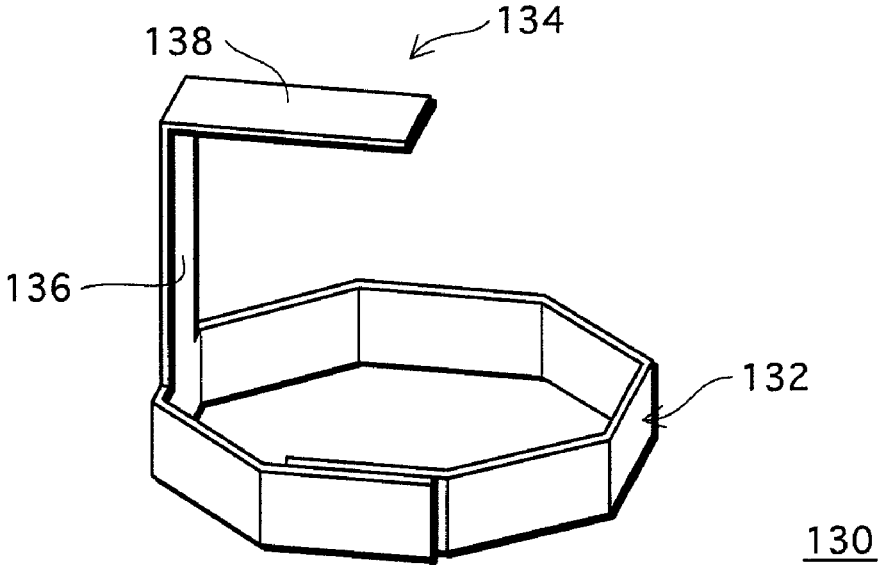
FIG. 8 is a view of a restrain member in accordance with a modification 3.

FIG. 8 is a view of a restrain member in accordance with a modification 3.

As shown in FIG. 8, a restrain member 130 in accordance with the modification 3 has an annular part 132 having a basically identical structure with that of the annular part 92, and a supporting part 134 integrated into the annular part 132.

The supporting part 134 includes an L-shaped part in a shape of the letter "L" composed of an extension part 136 and a flat part 138. The extension part 136 extends, from the annular part 132, in the central axis direction (extension direction of the central axis C in FIG. 4) of the annular part 132. At some point of the extension toward an opposite end to the annular part 132, the extension is bent in a direction orthogonal to the central axis of the annular part. The bent part of the extension is the flat part 138.

When the supporting part 134 is formed in a shape of the letter "L" as in the modification 3, the flat part 138 is still located between the tip-off part 90 of the inner tube 32 and the outer tube 34, which prevents the annular part 132 from moving in the lamp axis direction as a result of the insertion of the inner tube 32 into the outer tube 34. In addition, when the discharge tube 30 is broken for some reason, the supporting part 134 having the above structure prevents breakage of the outer tube 34 caused by the scatter of broken pieces of the tip-off part 90.

Figure 9:
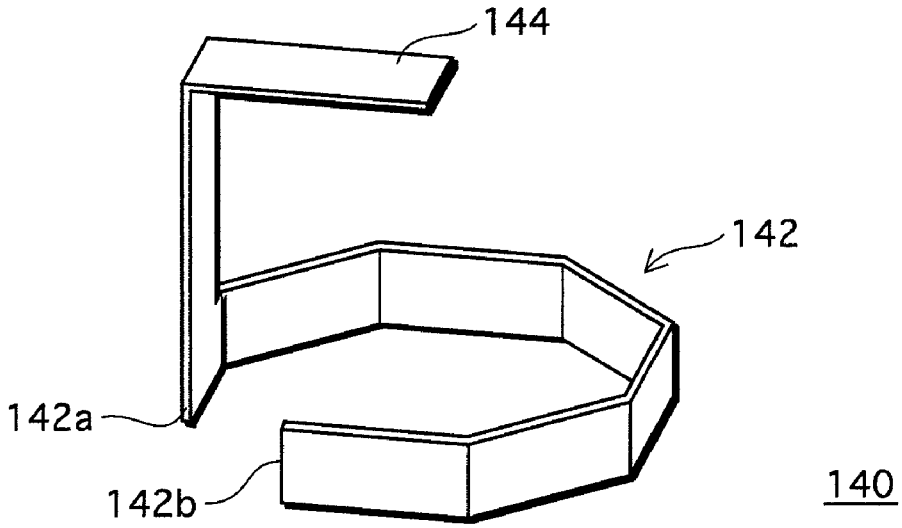
FIG. 9 is a view of a restrain member in accordance with a modification 4.

FIG. 9 is a view of a restrain member in accordance with a modification 4.

As shown in FIG. 9, a restrain member 140 in accordance with the modification 4 has an annular part 142 and a supporting part 144 having a basically identical structure with the supporting part 134 of the modification 3. The annular part 142 has end parts 142*a* and 142*b* not being overlapped with each other but being separate from each other in the circumferential direction.

Seen in the extension direction of the central axis of the annular part 142, the annular part 142 is in an annular shape that lacks one side of an octagon. The diameter of an inner circumference of the annular part 142 is smaller than that of an outer circumference of the inner tube 32. Thus, when the inner tube 32 is inserted, the annular part 142 is radially expanded, and the reaction to the expansion tightens up the inner tube 32.

c. Shape

The annular part in accordance with the embodiment and the above modifications is in an octagonal shape, seen in an extension direction of the central axis of the annular shape. However, other shapes than the octagonal shape are also applicable. For example, a circular shape and other multangular shape, such as a quadrangle shape and a hexagonal shape are applicable.

Note that in order to prevent the misalignment of the tube axes of the inner tube 32 and the outer tube 34, the annular part is to be in contact with, respectively at least at three points, the outer circumference of the inner tube and the inner circumference of the outer tube. The following describes a modification 5 where an annular part is in contact with the outer circumference of the inner tube and the inner circumference of the outer tube, respectively at three points.

Figure 10:
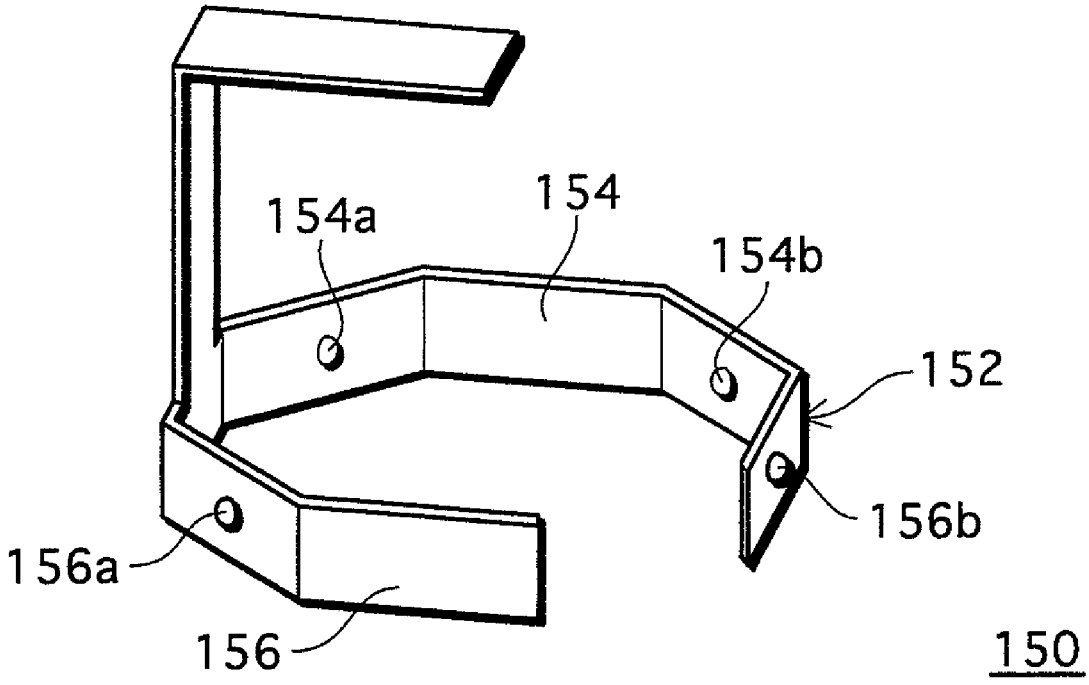
FIG. 10 is a view of a restrain member in accordance with a modification 5.

FIG. 10 is a view of a restrain member 150 in accordance with the modification 5.

The restrain member 150 of the modification 5 has a basically identical structure with that of the restrain member 140 of the modification 4. The restrain member 150 has projection parts 154*a*, 154*b*, 154*c*, 156*a*, 156*b* and 156*c*. The projection parts 154*a*, 154*b*, and 154*c* project out from an inner surface 154 at three given positions of the inner surface 154 of a plate-like member that composes the annular part 152. The projection parts 156*a*, 156*b* and 156*c* project out from an outer surface 156 at three given positions of an outer surface 156 of the plate-like member. Note that, for the sake of the simplicity of the drawing, the projection part 154*c* disposed on the inner surface 154 and the projection part 156*c* on the outer surface 156 are not shown in the drawing.

Arrangement may be made in the inside diameter of the annular part 152 or in a level of the projection of the projection parts 154*a*, 154*b* and 154*c* in such a manner that when the inner tube 32 is inserted into the annular part 152, the projection parts 154*a*, 154*b* and 154*c* are always in contact with the outer circumference of the inner tube 32. Additionally, only when the tube axis of the inner tube is displaced from the lamp axis, the inner tube 32 is to be in contact with the projection parts 154*a*, 154*b* and 154*c* in the displaced direction, which restrains the inner tube 32 from being further displaced in the displaced direction.

Similar arrangement may be made in the outside diameter of the annular part 152 or a level of the projection of the projection parts 156*a*, 156*b* and 156*c* in such a manner that when the inner tube 32 is inserted into the annular part 152 the projection parts 156*a*, 156*b* and 156*c* are always in contact with the inner circumference of the outer tube 34. Additionally, only when the tube axis of the inner tube is displaced from the lamp axis, the inner tube 32 is to be in contact with the projection parts 156*a*, 156*b* and 156*c* in the displaced direction, which restrains the inner tube 32 from further being displaced in the displaced direction.

Note that desirably there are at least three of the above projection parts equally spaced circumferentially. In addition, considering the function of the outer tube 34 as a safety catcher of the inner tube 32, it is desirable that the projection parts are in contact with the inner and outer tubes so as to press against the inner and outer tubes when the inner tube is inserted into the annular part.

(2) Arrangement

In the embodiment and the modifications 1-5, the restrain member is disposed at the top ends of the inner tube and the outer tube (opposite to the base). However, the restrain member may be disposed at other points.

The following describes modifications each having an additional restrain member.

Figure 11:
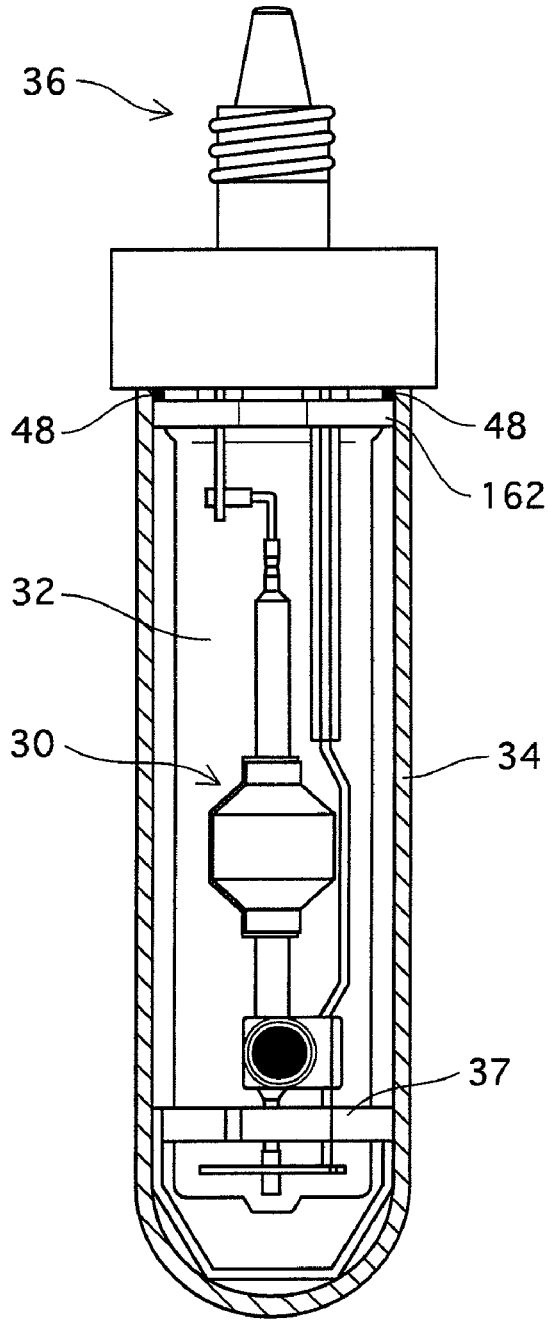
FIG. 11 is a view of a lamp in accordance with a modification 6.

FIG. 11 is a view of a lamp in accordance with a modification 6.

A lamp 160 in accordance with the modification 6 is basically identical with the lamp 14 of the embodiment. The only difference is that the lamp 160 has a second restrain member 162. For convenience sake, the restrain member 37 disposed in the lamp 14 of the embodiment is referred to as a first restrain member 37.

As shown in FIG. 11, the lamp 160 includes the discharge tube 30 having a pair of electrodes and a discharge space formed therein, the inner tube 32 housing the discharge tube 30, the outer tube 34 housing the inner tube 32, the base 36 used for supplying electricity to the pair of the electrodes, and the first restrain member 37 and the second restrain member 162 that are provided between the inner tube 32 and the outer tube 34.

The first restrain member 37 has a basically identical structure with that of the embodiment and is located at a basically identical position with that of the embodiment. The second restrain member 162 is disposed at ends of the inner tube 32 and the outer tube 34 toward the base 36, for example, at the pinch-sealed part 86.

The second restrain member 162 fills the clearance between the inner tube 32 and the outer tube 34, which determines a location of the inner tube 32 with regard to the outer tube 34. That is to say, when the clearance (distance) between (the outer surface of) the inner tube 32 and (the inner surface of) the outer tube 34 is large, the moving distance of the inner tube 32 relative to the inner surface of the outer tube 34 is large. On the other hand, as shown in the modification 6, the second restrain member 162 provided between (the outer surface of) the inner tube 32 and (the inner surface of) the outer tube 34 make the clearance (movable distance of the inner tube) smaller. Thus, the moving distance of the inner tube 32 relative to the inner surface of the outer tube 34 can be reduced, and the displaced length of the inner tube 32 relative to the outer tube 34 can also be reduced.

Note that it is desirable that the first restrain member 37 and the second restrain member 162 are located at least mm away from approximately the center of the discharge tube 30. That is to say, the location is desirably 5 mm away from approximately the center between the pair of the electrodes in the lamp axis direction. This is because by disposing the first restrain member 37 and the second restrain member 162 in the above manner, light volume of the discharge lamp 14 screened by the first restrain member 37 and the second restrain member 162 is kept to be 20% or less of the light volume of a lamp without the restrain member.

Figure 12:
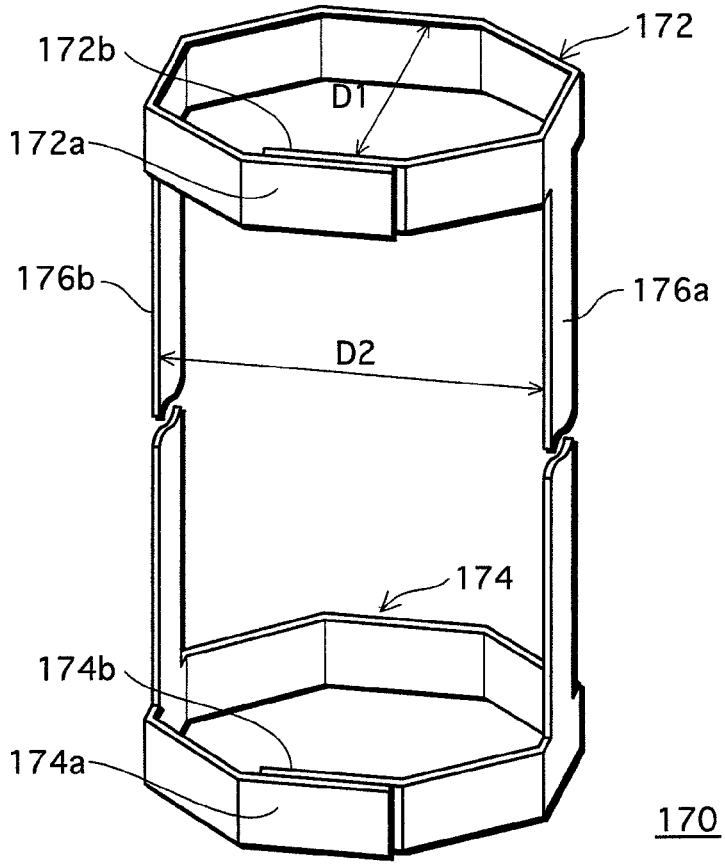
FIG. 12 is a perspective view of a restrain member in accordance with a modification 7.

FIG. 12 is a perspective view of a restrain member in accordance with a modification 7.

In the modification 6, the first restrain member 37 and the second restrain member 162 are two separate things. In the modification 7, however, as shown in FIG. 12, a restrain member 170 in accordance with the modification 7 includes a first annular part 174 (corresponding to the first restrain member 37 of the modification 6), a second annular part 172 (corresponding to the second restrain member 162 of the modification 6) and connection parts 176*a* and 176*b* each connecting the first and second annular parts 174 and 172.

The first annular part 174 is made of a plate-like member. End parts 174*a* and 174*b* of the annular part 174 are overlapped with each other to be movable in a circumferential direction of the annular part 174. As the inner tube 32 is inserted, the annular part 174 is radially expanded. Note that the first annular part 174 is placed at the end of the inner tube 32 that is opposite to the pinch-sealed part 86.

The second annular part 172 is made of a plate-like member. End parts 172*a* and 172*b* of the annular part 172 are overlapped with each other to be movable in a circumferential direction of the annular part 172. As the inner tube 32 is inserted, the annular part 172 is radially expanded. Note that the second annular part 172 is provided at the pinch-sealed part 86.

Seen in the extension direction of the central axis of the annular part, the second annular part 172 is in a flat annular shape. That is to say, the sizes of "D1" and "D2" in FIG. 12 are different from each other (D1<D2) for the following purpose. The pinch-sealed part 86 that is an end of the inner tube 32 is in a flat shape because the pinch-sealed part 86 is pinched and sealed. When the shape of the second annular part 172 is made identical to the shape of the pinch-sealed part 86, the restrain member 170 is prevented from falling off when the base is on the upside.

Note that when the inside diameter of the annular shape of each of the first annular part 174 and the second annular part 172 is smaller than that of the outer circumference of the inner tube 32 at some position thereof, the first and second annular parts 172 and 174 at the position are prevented from moving in the lamp axis direction.

Figure 13:
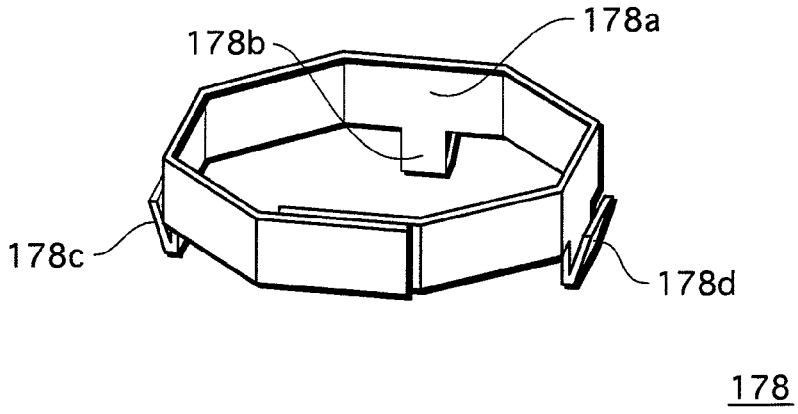
FIG. 13 is a perspective view of an annular part in accordance with a modification 8.

FIG. 13 is a perspective view of an annular part in accordance with a modification 8.

An annular part 178 in accordance with the modification 8 includes an annular part main body 178*a*. The annular part main body 178*a* includes elastic claws 178*b*, 178*c* and 178*d* that are elastically deformable in a radial direction of the annular shape. The elastic claws 178*b*, 178*c* and 178*d* extend, for example, from the main body part 178*a*, toward the extension direction of the central axis of the annular part main body 178*a*. At some point of the extension, each of the elastic claws 178*b*, 178*c* and 178*d* are bent outwardly (to the outside of the annular shape).

The annular part 178 has a structure where the diameter of the inner circumference of the annular part main body 178*a* is radially expanded. Accordingly, when the inner tube 32 is inserted into the annular part main body 178*a*, since the annular part 178 tightens the inner tube 32 with use of resilience of the annular part main body 178*a*, the annular part 178 is prevented from falling off the inner tube 32. In addition, the radial expansion of the annular part 178 causes the elastic claws 178*b*, 178*c* and 178*d* to come in contact with the inner circumferential surface of the outer tube 34 and consequently to be bent internally to the annular shape. Thus, the elastic claws 178*b*, 178*c* and 178*d* press against the inner surface of the outer tube 34, which prevents the outer tube 34 from falling off the inner tube 32. Thus, the elastic claws 178*b*, 178*c* and 178*d* press against the inner surface of the outer tube 34, which prevents the outer tube 34 from falling off the inner tube 32.

The elastic claws 178*b*, 178*c* and 178*d* are structured in such a manner that the elastic claws 178*b*, 178*c* and 178*d* press against the inner circumferential surface of the outer tube 34 when the annular part 178 is provided between the outer tube 34 and the inner tube 32. For example, the diameter of the circumference defined by the elastic claws is smaller than the inside diameter of the outer tube 34. Consequently, the elastic claws press against the outer tube 34, which prevents the outer tube 34 from falling off the inner tube 32.

Note that the following number and positions of the elastic claws are applicable. At least three of the elastic claws are approximately equally spaced in the circumferential direction of the annular part main body. For example, there may be an elastic claw only between the two adjacent elastic claws that are equally spaced (in this case, there are four elastic claws, and the elastic claws are not equally spaced). Alternatively, there may be four or more of the elastic claws each having an approximately equal spacing between its adjacent elastic claws, or there may be a plurality of the elastic claws that are irregularly spaced.

(3) Others

In the modifications 6-7, in order to restrain the misalignment between the inner tube 32 and the outer tube 34, the restrain member 170, and the first and second restrain members 37 and 162 are provided at two points: one is at the top end of the outer tube 34, and the other is the end of the outer tube 34 near the base 36.

Considering the misalignment between the inner tube 32 and the outer tube 34, especially the inclination of the central axis of the outer tube 34 relative to the central axis of the inner tube 32, as shown in FIG. 11, it is desirable that the restrain members (37, 162) are provided at the two points. However, for example, when the central axis of the outer tube 34 is displaced in a parallel direction with the central axis of the inner tube 32, the restrain member provided only at the one end of the outer tube 34 near the base 36 is effective.

Accordingly, only the restrain member as described in the modifications 9-13 may be used. Alternatively, both of the restrain member provided at the top end of the outer tube as described in the modifications 6-7 and the restrain member as described in the modifications 9-13 may be used.

The following describes a modification where the restrain member is provided only at the end of the outer tube 32 near the base 36.

Figure 14:
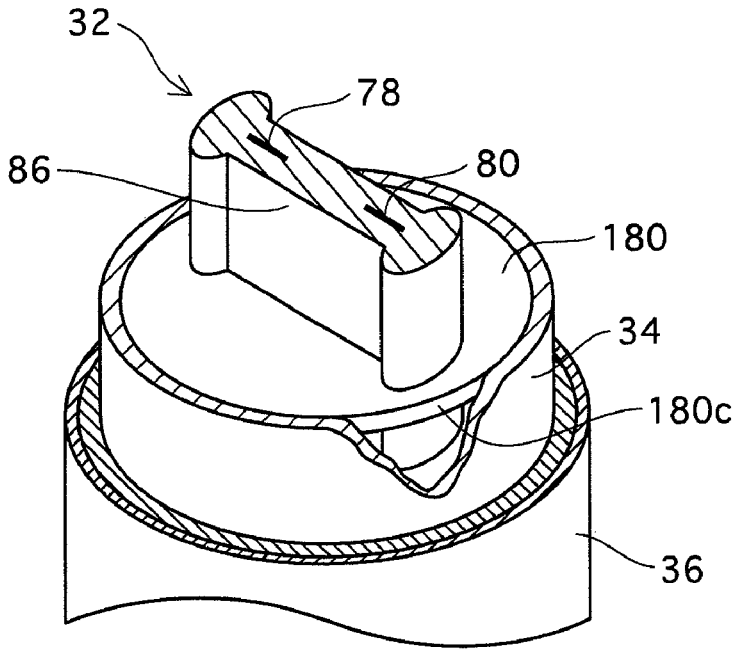
FIG. 14 is a partially cutout, enlarged perspective view of a base of a lamp in accordance with a modification 9.
Figure 15:
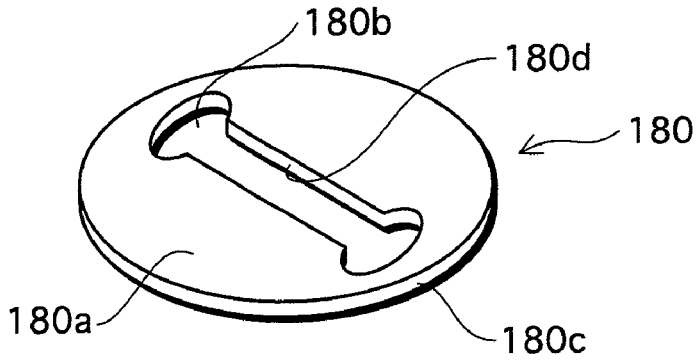
FIG. 15 is a perspective view of a restrain plate in accordance with the modification 9.

FIG. 14 is a partially cutout enlarged perspective view of a base of a lamp in accordance with the modification 9. FIG. 15 is a perspective view of a restrain plate 180 in accordance with the modification 9.

The lamp of the modification 9 is basically identical with the lamp 14 of the embodiment. Only the difference is that the lamp of the modification 9 does not have the restrain member 37 but has the restrain plate 180 provided at the end of the outer tube 34 toward the base 36. Because of this, as shown in FIG. 14, the identical reference numerals with those of the embodiment are used for parts and members that constitute the lamp of the modification 9.

As shown in FIG. 15, the restrain plate 180 in accordance with the modification 9 has the following structure. A through hole 180*b* is formed at the central part of a flat plate main body 180*a* in a discoidal shape. The outside diameter of the flat plate main body 180*a* is just equal to the inside diameter of the outer tube 34. As shown in FIG. 14, when the restrain plate 180 is mounted as a part of the lamp, a circumferential surface 180*c* of the flat plate main body 180*a* is in contact with the inner circumferential surface of the outer tube 34.

The through hole 180*b* of the restrain plate 180 has a shape that matches a shape of a cross section of the pinch-sealed part 86 of the inner tube 32. The through hole 180*b* is formed as follows. The through hole 180*b* is located on the flat plate main body 180*a* in such a manner that the central axes of the inner tube 32 and the outer tube 34 are in alignment when the inner tube 32 is housed within the outer tube 34.

As shown in FIG. 14, the through hole 180*b* of the restrain plate 180 is structured as follows. When the restrain plate 180 is mounted as a part of the lamp, the pinch-sealed part 86 is fitted into the through hole 180*b*. That is to say, a circumferential surface 180*d* that forms the through hole 180*b* of the flat plate main body 180*a* is in contact with the pinch-sealed part 86 along the whole circumference, or at a plurality of points.

Subsequently, a description is made on a process of assembling the lamp in accordance with the modification 9.

FIGS. 16A, 16B, 16C and 16D are views showing the process of assembling the lamp.

The lamp of the modification 9 is assembled through a mounting process (FIG. 5A), an attaching process (FIG. 5B) and a fixing process (FIG. 5D). In the mounting process, the restrain plate 180 is mounted on the inner tube 32. In the attaching process, the base 36 is attached to the inner tube 32 on which the restrain plate 180 is mounted. In the fixing process, the outer tube 34 is fixed to the base 36 to which the inner tube 32 is attached.

Figure 16:
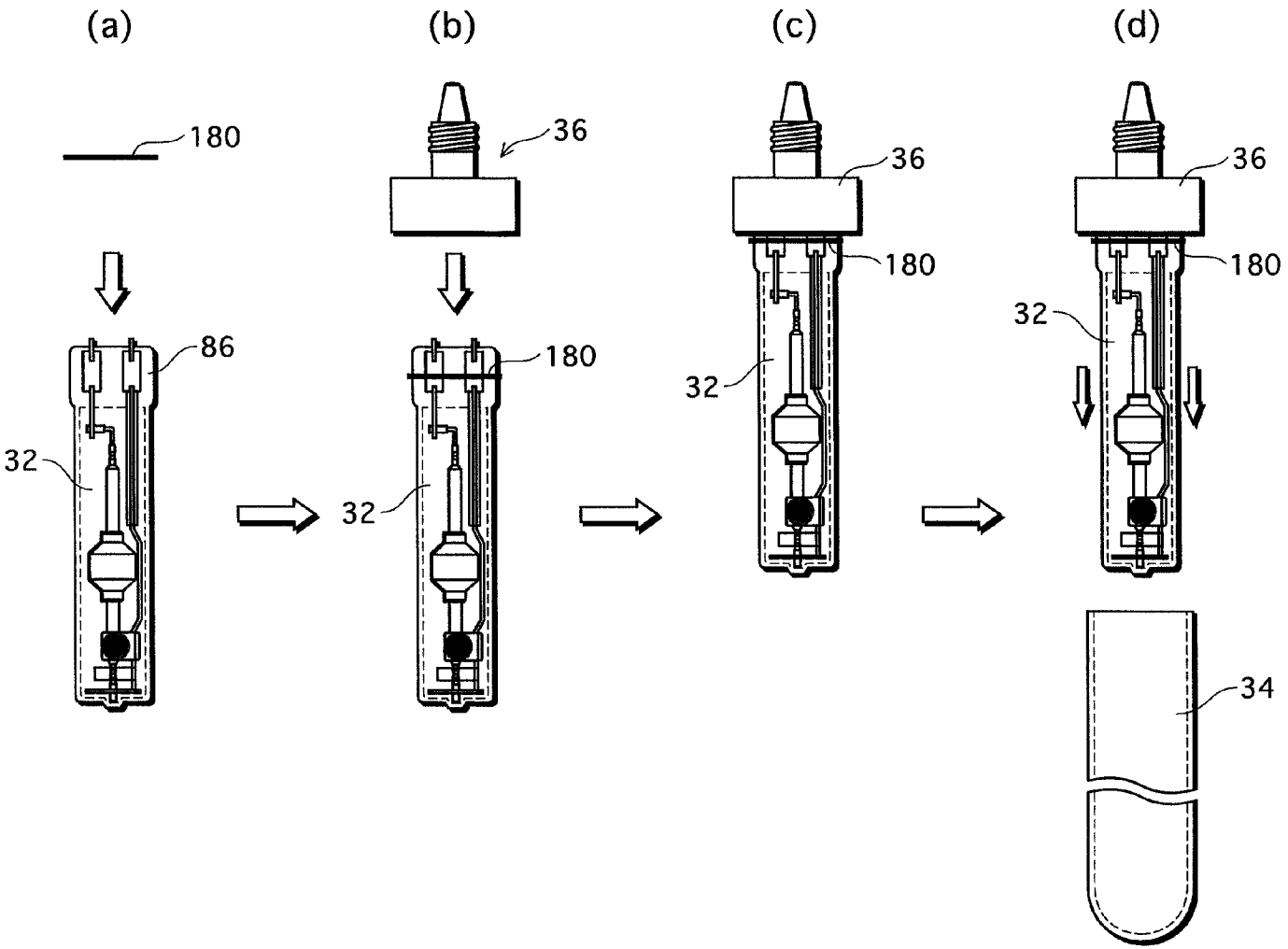
FIGS. 16A, 16B, 16C and 16D are views showing a process for assembling the lamp.

In the mounting process, as shown in FIG. 16A, the inner tube 32 and the restrain plate 180 are prepared, and the restrain plate 180 is mounted on the pinch-sealed part 86 of the inner tube 32. More specifically, when the pinch-sealed part 86 is inserted into the through hole 180*b* of the restrain plate 180 and when the restrain plate 180 is fitted over the pinch-sealed part 86, the restrain plate 180 is relatively moved to a given position of the inner tube 32.

In the attaching process, the inner tube 32 on which the restrain plate 180 is mounted and the base 36 are prepared. After applying an adhesive (e.g. cement) to at least one of connection parts of the inner tube 32 and the base 36, the inner tube 32 and the base 36 are bonded. Thus, as shown in FIG. 16C, the inner tube 32 on which the restrain plate 180 is mounted is attached to the base 36. Note that the attachment of the inner tube 32 to the base 36 is described later.

In the fixing process, the inner tube 32 to which the base 36 is attached and the outer tube 34 are prepared. After applying an adhesive (e.g. cement) to at least one of connection parts of the base 36 and the outer tube 34, as shown in FIG. 16D, the inner tube 32 is relatively inserted into the outer tube 34.

In this status, the restrain plate 180 is provided between the inner tube 32 and the outer tube 34 at the ends thereof toward the base 36. Accordingly, at the ends thereof toward the base 36, the inner tube 32 and the outer tube 34 can be hardly displaced from each other.

Figure 17:
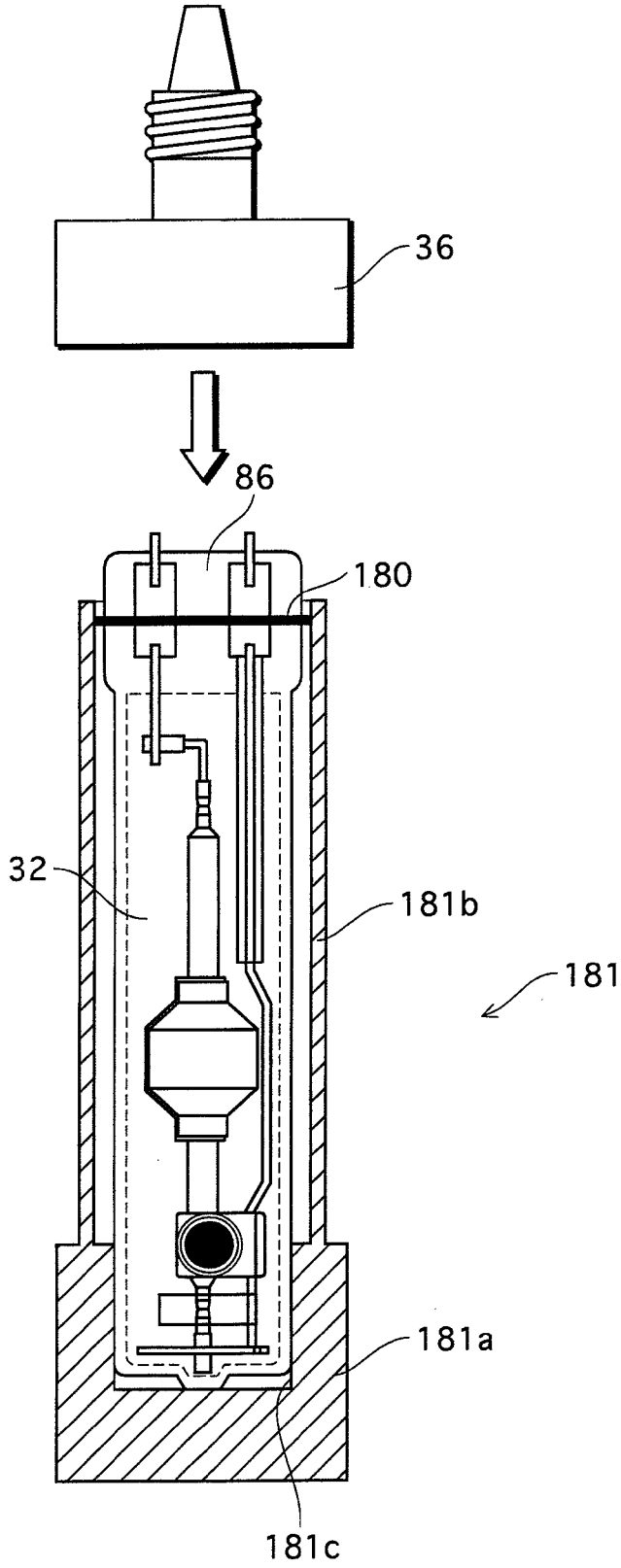
FIG. 17 is a view showing an attaching process in accordance with the modification 9.

FIG. 17 is a view showing the attaching process.

To attach the base 36 and the inner tube 32 on which the restrain plate 180 is mounted, for example, an attachment 181 as shown in FIG. 17 is used.

The attachment 181 includes a base part 181*a* and a tube part 181*b* erected on the base part 181*a*.

The tube part 181*b* is in a shape of a straight tube whose size is identical with the inside diameter of the outer tube and holds the inner tube 32 inserted therein. In this case, the circumferential surface 180*c* of the restrain plate 180 is in contact with the inner circumferential surface of the tube part 181*b* along the whole circumference.

On the base part 181*a*, a fixing hole 181*c* is formed at a position corresponding to the top end (end opposite to the pinch-sealed part 86) of the inner tube 32. The inside diameter of the fixing hole 181*c* is as long as (actually a little longer than) the outside diameter of the top end of the inner tube 32.

The tube part 181*b* is assumed to be the outer tube 34. An imaginary line connecting the center of the fixing hole 181*c* and the center of the restrain plate 180 is substantially in alignment with the central axis of the tube part 181*b*. Thus, the inner tube 32 can be attached to the base 36 while preventing the misalignment of the central axes of the inner tube and the tube part 181*a* (corresponding to the outer tube 32).

On the condition that the restrain plate 180 is mounted as apart of the lamp as described above, the circumferential surface 180*c* of the restrain plate 180 is in contact with the inner circumferential surface of the outer tube 34, and the circumferential surface 180*d* that is the rim of the through hole 180*b* corresponding the pinch-sealed part 86 is in contact with the pinch-sealed part 86. Thus, the displacement of the inner tube 32 relative to the outer tube 34 can be prevented. That is to say, the restrain member (180) in accordance with the modification 9 has an intermediate part between the inner circumferential surface of the outer tube and the inner tube. This intermediate part serves to prevent the inner tube from moving (displacing) toward the outer tube.

The restrain plate 180 of the modification 9 has the though hole 180*b* corresponding the pinch-sealed part 86 of the inner tube 32. The restrain plate 180 may have a contact part so as to increase an area contacted with the inner tube. A restrain plate having the contact part is described as the modification 10.

Figure 18:
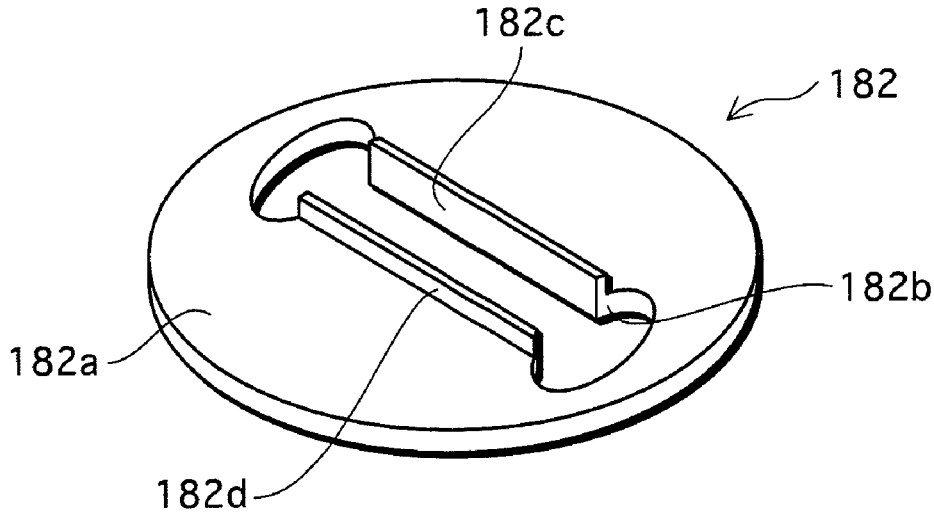
FIG. 18 is a perspective view of a restrain member in accordance with a modification 10.

FIG. 18 is a perspective view of a restrain plate 182 in accordance with the modification 10.

As shown in FIG. 18, the restrain plate 182 includes a flat plate main body 182*a* in a discoidal shape, a through hole 182*b* formed approximately at the center of the flat plate main body 182*a* and being at a position corresponding to the pinch-sealed part of the inner tube, contact parts 182*c* and 182*d* each provided along a flat part of the pinch-sealed part of the inner tube.

The contact parts 182*c* and 182*d* have portions each corresponding to the flat part of the pinch-sealed part of the flat plate main body 182*a*. The contact parts 182*c* and 182 are each bent in such a manner that the portions oppose each other. The pinch-sealed part is inserted between the pair of the contact parts 182*c* and 182*d*.

The outer circumference of each of the restrain plates 180 and 182 of the modifications 9 and 10 is in an annular shape. However, as long as the restrain plates are each in contact with the inner circumferential surface of the outer tube at a plurality of points (considering the prevention of the displacement of the inner tube relative to the outer tube, it is desirable that the restrain plate is in contact with the inner circumferential surface at three or more points that are spaced circumferentially), the displacement of the inner tube relative to the outer tube can be restrained.

Figure 19:
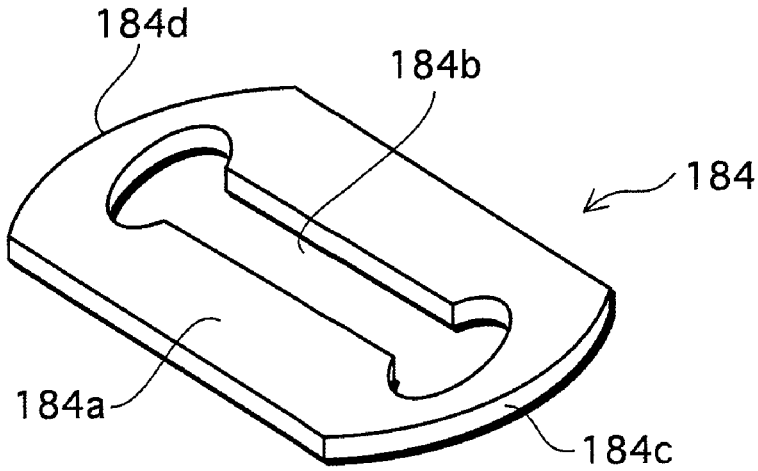
FIG. 19 is a perspective view of a restrain member in accordance with a modification 11.

FIG. 19 is a perspective view of a restrain plate 184 in accordance with the modification 11.

As shown in FIG. 19, the restrain plate 184 includes a flat plate main body 184*a* in a discoidal shape, a through hole 184*b* formed approximately at the center of the flat plate main body 184*a* and corresponding to the pinch-sealed part of the inner tube the following shape In a plan view, the flat plate main body 184*a* is nearly in an annular as follows. A pair of arcs outside of parallel lines facing each other across the center of the annular shape is cut off. Another pair of arcs of the flat plate main body 184*a* being in contact with the inner circumferential surface of the outer tube are referred to as a pair of contact parts 184*c* and 184*d*.

Figure 20:
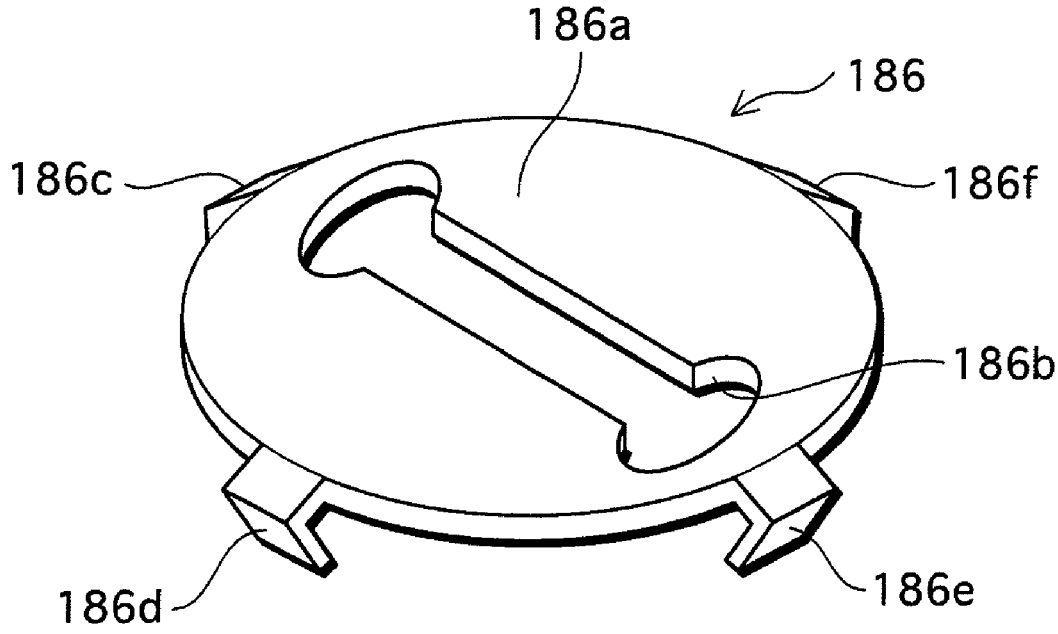
FIG. 20 is a perspective view of a restrain member in accordance with a modification 12.

FIG. 20 is a perspective view of a restrain member 186 in accordance with the modification 12.

As shown in FIG. 20, the restrain plate 186 includes a flat plate main body 186*a* in a discoidal shape, a through hole 186*b* formed approximately at the center of the flat plate main body 186*a* and being at a position corresponding to the pinch-sealed part of the inner tube, and a plurality (e.g. four) of spring parts 186*c*, 186*d*, 186*e* and 186*f* provided at the rim of the flat plate main body 186*a*.

The outside diameter of the flat plate main body 186*a* is a little smaller than those of the flat plate main bodies 180*a*, 182*a* and 184*a* of the modifications 9-11.

There are four of the spring parts 186*c*, 186*d*, 186*e* and 186*f* that are equally spaced in the circumferential direction and are each extending in a converted "V" shape from the rim of the flat plate main body 186*a*. The spring parts 186*c*, 186*d*, 186*e* and 186*f* are elastically deformable in a radial direction of the flat plate main body 186*a*.

Thus, when the inner tube is inserted into the outer tube on the condition that the restrain plate 186*a* is mounted on the inner tube, the spring parts 186*c*, 186*d*, 186*e* and 186*f* are deformed in the radial direction (the diameter of the restrain plate is reduced as a whole). In addition, with the spring parts 186*c*, 186*d*, 186*e* and 186*f* pressing against the inner circumferential surface of the outer tube, the restrain plate 186*a* is inserted to reach a given position within the outer tube.

Although the restrain members (restrain plates 180, 182, 184 and 186) in accordance with the modifications 9-12 have the flat plate main bodies 180*a*, 182*a*, 184*a* and 186*a*, respectively, the restrain member be composed of other components than the flat plate main bodies 180*a*, 182*a*, 184*a* and 186*a*. The following describes modifications 13 and 14 where the restrain member has the other component.

Figure 21:
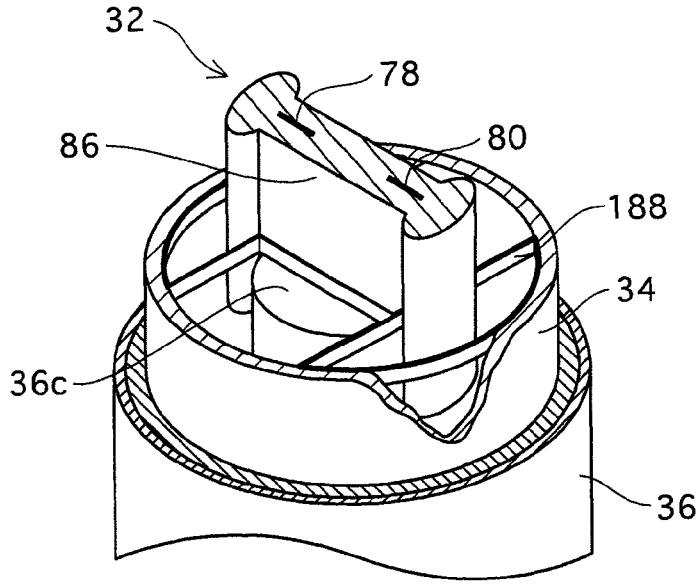
FIG. 21 is a partially cutout, enlarged perspective view of a base of a lamp in accordance with a modification 13.
Figure 22:
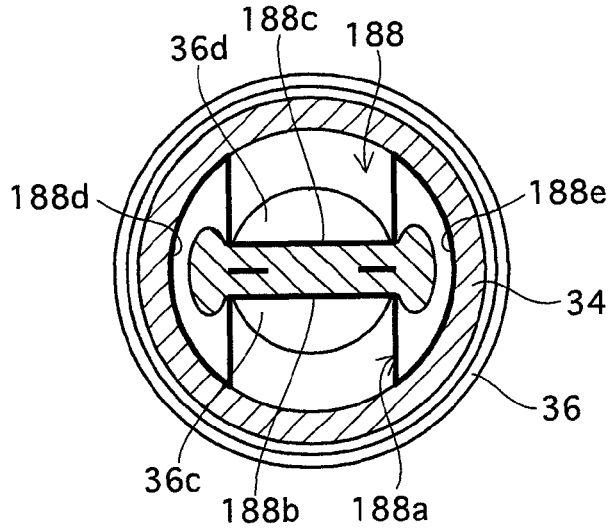
FIG. 22 is a plan view of a base of a lamp in accordance with the modification 13.
Figure 23:
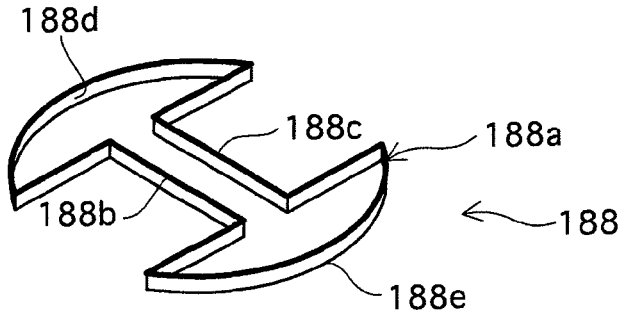
FIG. 23 is a perspective view of a restrain member in accordance with the modification 13.

FIG. 21 is a partially cutout enlarged perspective view of a base of a lamp in accordance with the modification 13. FIG. 22 is a plan view of a base of the lamp of the modification 13. FIG. 23 is a perspective view of a restrain member 188 in accordance with the modification 13.

The lamp of the modification 13 is basically identical with the lamp 14 of the embodiment. Only the difference is that the lamp of the modification 13 does not have the restrain member 37 but has the restrain plate 188 provided at the end of the outer tube 34 toward the base 36. Because of this, as shown in FIG. 21, the identical reference numerals with those of the embodiment are used for parts and members that constitute the lamp of the modification 13.

The inner tube 32 is mounted on the base 36 as follows. The pinch-sealed part 86 of the inner tube 32 is secured, with use of cement or the like, between a pair of supporting parts 36*c* and 36*d* formed within the base 36 (see FIG. 34).

As shown in FIG. 23, the restrain member 188 of the modification 13 has a belt-shaped member 188*a* in a belt shape that is bent and curved in order to be in contact with both of the inner circumference of the outer tube 34 and the outer circumference of the inner tube 32. More specifically, the restrain member 188 has inner tube contact parts 188*b* and 188*c* and outer tube contact parts 188*d* and 188*e*. The inner tube contact parts 188*b* and 188*c* are in contact with the outer circumference of the inner tube 32 at a plurality of points (two in this modification). The outer tube contact parts 188*d* and 188*e* are in contact with the inner circumference of the outer tube 34 at a plurality of points (two in this modification).

As shown in FIGS. 21 and 22, the inner tube contact parts 188*b* and 188*c* are each linearly arranged along the surface of the pinch-sealed part 86 of the inner tube 32. The outer tube contact parts 188*d* and 188*e* are each forms an arc to be fitted along the inner circumferential surface of the outer tube 34 whose cross sectional shape is in an annular shape.

Also in the modification 13, the outer tube contact parts 188*d* and 188*e* are in contact with the inner circumferential surface of the outer tube 34, and the inner tube contact parts 188*b* and 188*c* are in contact with the pinch-sealed part 86. Thus, the displacement of the inner tube 32 relative to the outer tube 34 can be prevented. More specifically, the restrain member 188 of the modification 13 has an intermediate part between the inner circumferential surface of the outer tube 34 and the inner tube 32. This intermediate part serves to prevent the inner tube from moving (displacing) toward the outer tube.

Figure 24:
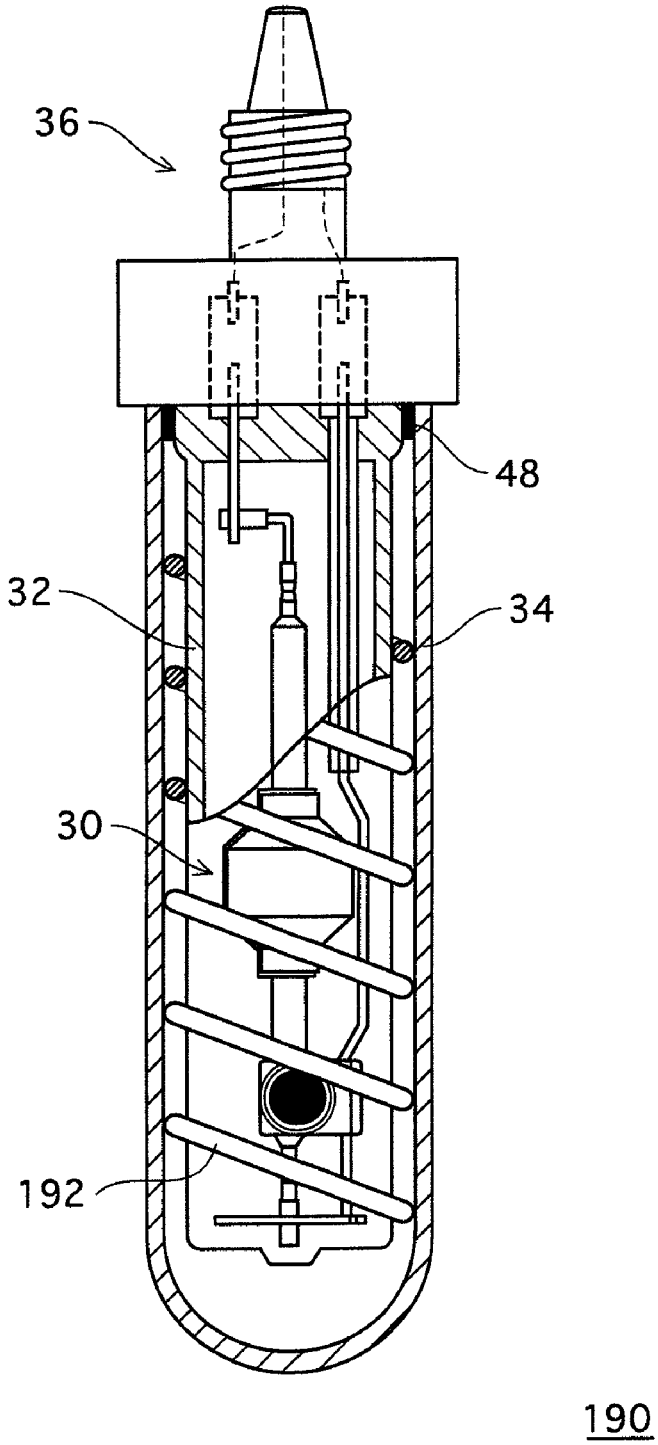
FIG. 24 is an elevational view of a lamp in accordance with a modification 14.

FIG. 24 is an elevational view of a lamp 190 in accordance with the modification 14.

The lamp 190 of the modification 14 is basically identical with the lamp 14 of the embodiment. Only the difference is that the lamp 190 of the modification 14 does not have the restrain member 37 of the lamp 14 but has a restrain member 192 provided between the outer tube 34 and the inner tube 32. Note that, as shown in FIG. 24, the identical reference numerals with those of the embodiment are used for parts and members that constitute the lamp 190 of the modification 14.

As shown in FIG. 24, the restrain member 192 is made of a coiled wire whose diameter approximately corresponds to a distance between the inner circumferential surface of the outer tube 34 and the outer circumferential surface of the inner tube 32 ((inside diameter of outer tube−outside diameter of inner tube)/2). Also in this case, the restrain member 192 is provided between the inner circumferential surface of the outer tube 34 and the outer circumferential surface of the inner tube 32, which prevents the inner tube from moving (displacing) toward the outer tube.

The restrain member 192 of the modification 14 is in the following shape. When the wire winds around the coil axis (equivalent to the central axis of the lamp), the turning radius of the wire is constant. More specifically, seen in an extension direction of the coil axis, the restrain member is in an annular shape.

However, seen in the extension direction of the coil axis, the restrain member may be in other shapes than the annular shape. The following describes a modification 15 where a restrain member is not in the annular shape.

Figure 25:
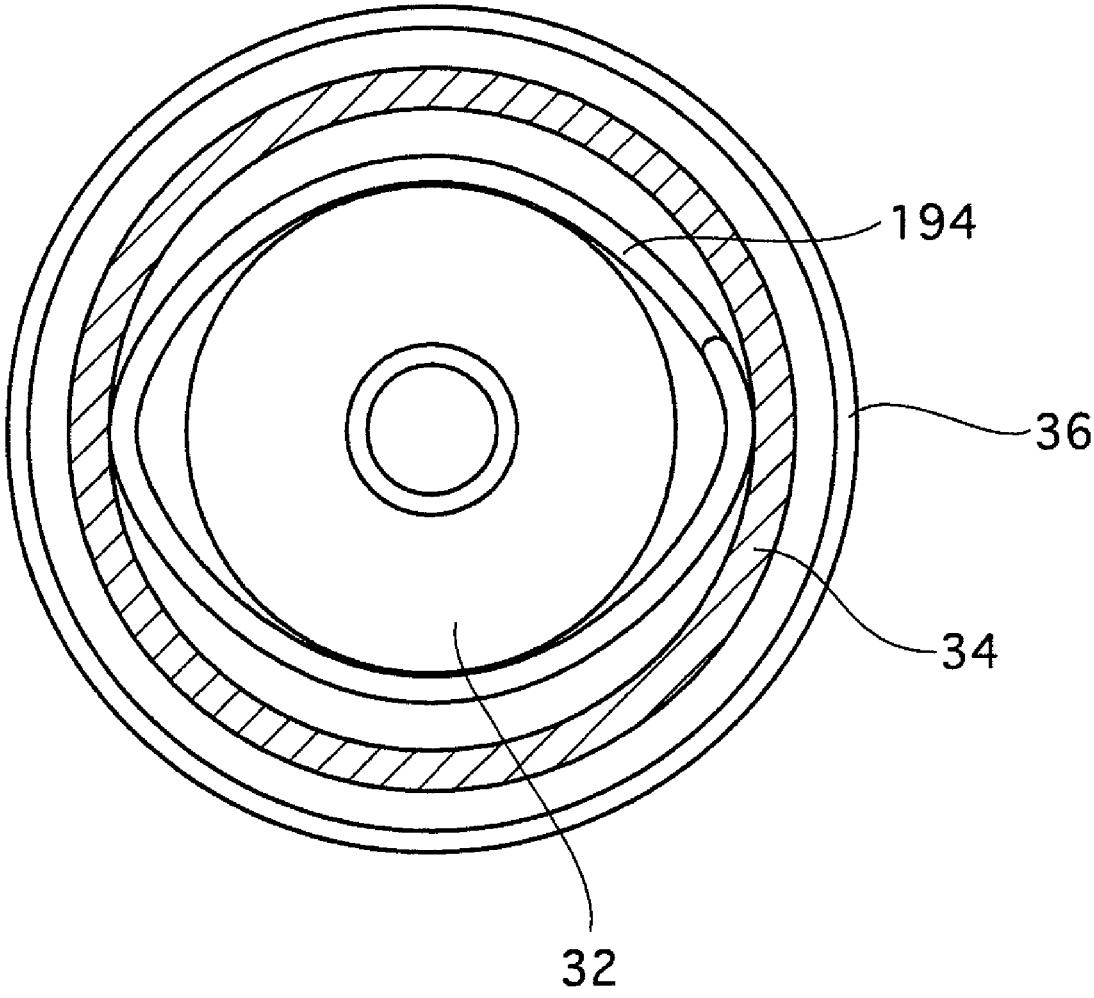
FIG. 25 is a plan view of a lamp in accordance with a modification 15.

FIG. 25 is a plan view of a lamp in accordance with the modification 15.

As shown in FIG. 25, the restrain member 194 is in an ellipsoidal shape, seen in the extension direction of the coil axis. In this case, the inner surfaces of the restrain member having a smaller diameter of the ellipsoidal shape is in contact with the outer circumferential surface of the inner tube 32, and the outer surfaces of the restrain member having a longer diameter of the ellipsoidal shape is in contact with the inner circumferential surface of the outer tube 34.

(4) Material

The embodiment and the modifications 1-15 do not specifically describe a material of the restrain member. The restrain member is desirably made of a material deformable according to the insertion of the inner tube and resistant to heat generated by the discharge tube during the operation of the lamp. For example, stainless (SUS), aluminum or the like may be used for the restrain member.

The restrain member described in the embodiment and the modifications 1-15 is made of a bent and curved plate-like member obtained by punching a large plate. This plate-like member may be made of a mesh material, or may have a plurality of through holes.

The restrain member made of a mesh material has light blocking effect, which prevents glaring caused by mounting the restrain member.

Considering the light output efficiency of the lamp, a material with good reflectance (e.g. reflectance of 80% or over) is preferable for the restrain member. Note that the restrain member may be made of a transparent material (e.g. glass, ceramic). In this case, although it is difficult for the annular part thereof to be expanded radially, the restrain member made of a transparent material serves to reduce the clearance between the inner tube and the outer tube.

2. Lamp (1) Position of Electrode

The lamp of the embodiment employs an electrode type that a pair of the electrodes 50, and 52 (electrode rods) extending parallel to the lamp axis, and approximately opposed to each other along the lamp axis. However, the lamp may employ a different type.

Figure 26:
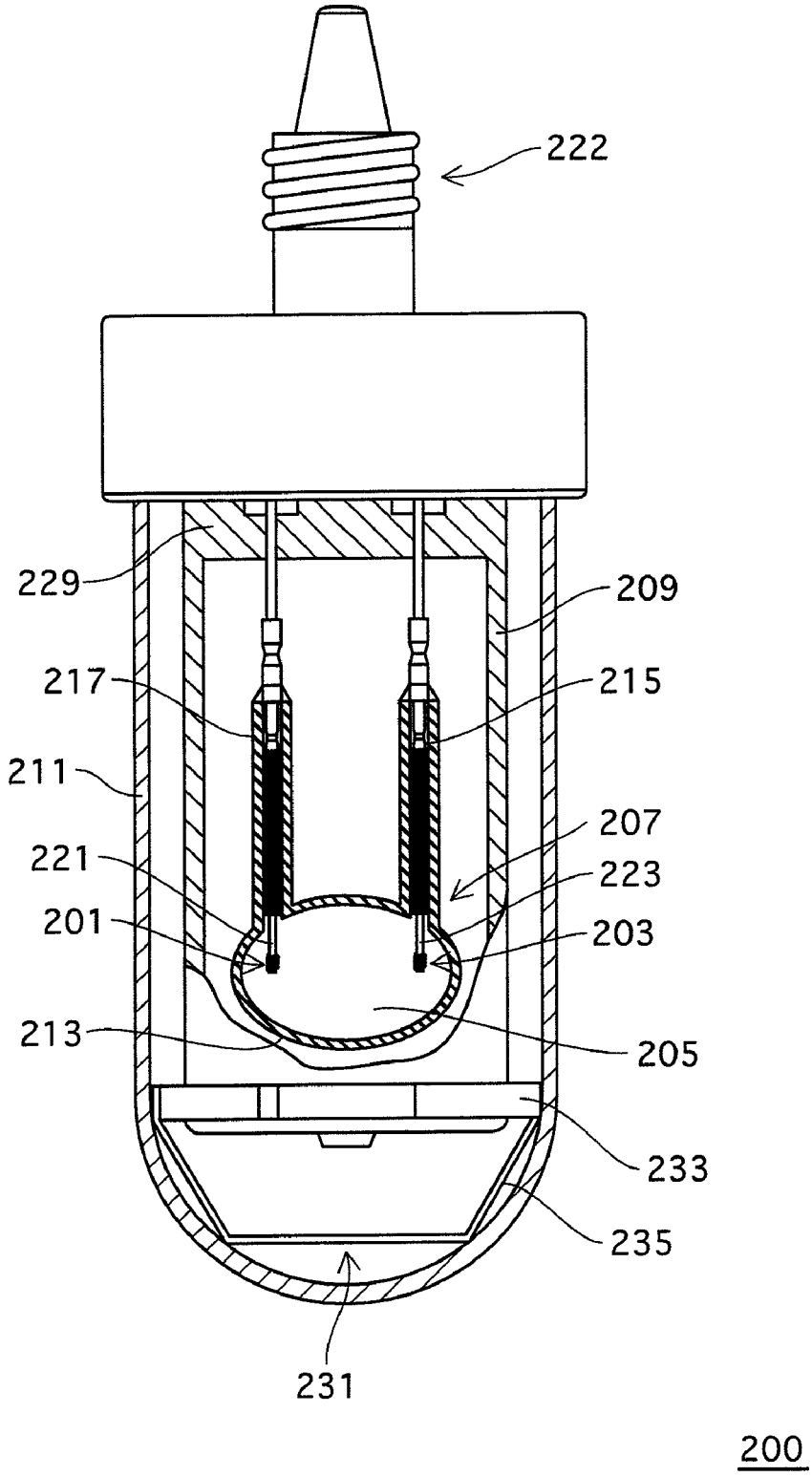
FIG. 26 is an elevational sectional view of a lamp in accordance with a modification 16.

FIG. 26 is an elevational sectional view of a lamp 200 in accordance with a modification 16.

As shown in FIG. 26, the lamp 200 has a triple-tube structure, with a discharge tube 207 in which a discharge space 205 is formed therein, an inner tube 209 that is an airtight envelope housing the discharge tube 207, and an outer tube 211 that is a protective envelope housing the inner tube 209. The lamp 200 includes a pair of electrodes 201 and 203 inside the discharge space 205. The lamp 200 further includes a base 222 receiving power from a socket of a lighting apparatus, and a restrain member 231 provided between the inner tube 209 and the outer tube 211.

The discharge tube 207 includes a main body part 213 with the airtight discharge space 205 therein and thin tube parts 215 and 217 provided at the main body part 213.

As shown in FIG. 26, the main body part 213 is in a shape of an approximately ellipsoidal sphere. The main body part 213 is housed in the inner tube 209 in such a manner that the longitudinal axis of the main body part 213 is approximately orthogonal to the lamp axis of the lamp 200. The thin tube parts 215 and 217 extend outwardly in a direction orthogonal to the longitudinal direction of the main body part 213 (i.e. parallel direction to the lamp axis).

The main tube body part 213 and the thin tube parts 215 and 217 are made of, for example, transparent ceramic. Within the discharge space 205, given amounts of metal halide, a rare gas, and mercury are enclosed, as with the embodiment.

As with the embodiment, a pair of the electrodes 201 and 203 includes electrode rods 221 and 223, and electrode coils disposed at ends (toward the discharge space 205) of the electrode rods 221 and 223. At another ends of the electrode rods 221 and 223, power feeders are connected, as with the embodiment.

The electrode rods 221 and 223 of the electrodes 201 and 203 extend in parallel to the lamp axis. The electrode rods 221 and 223 seal the thin tube parts 215 and 217 in such a manner that an imaginary line connecting between the top ends of the electrodes 201 and 203 intersects the lamp axis approximately at a right angle. Note that the electrodes 201 and 203 seal the thin tube parts 215 and 217 with use of the same method with the embodiment.

As shown in FIG. 26, the discharge tube 207 and the like are housed within the inner tube 209 in a tubular shape, such as a cylindrical shape whose cross section is in a circular shape. The inner tube 209 is made of, for example, quartz glass. An end of the inner tube 209 toward where metal foil is (toward the base 222) is a pinch-sealed part 229, as with the embodiment.

The restrain member 231 includes, for example, an annular part 233 that is radially expandable according to the insertion of the inner tube 209 and a supporting part 235, as with the embodiment.

Although a lighting fixture that employs the lamp 200 is not especially described, note that such a lighting fixture is applicable if the lamp 200 is mounted on the lighting fixture (12) shown in FIG. 1 of the embodiment.

(2) Outer Tube a. Shape

In the above embodiment, the outer tube 34 is in a bottomed tubular shape having one open end (toward the base) and one closed end in a hemispherical shape. However, the outer tube in accordance with the present invention is not limited to the shape described in the embodiment. The following describes a lamp with an outer tube in a different shape from that of the embodiment.

a1. Modification 17

Figure 27:
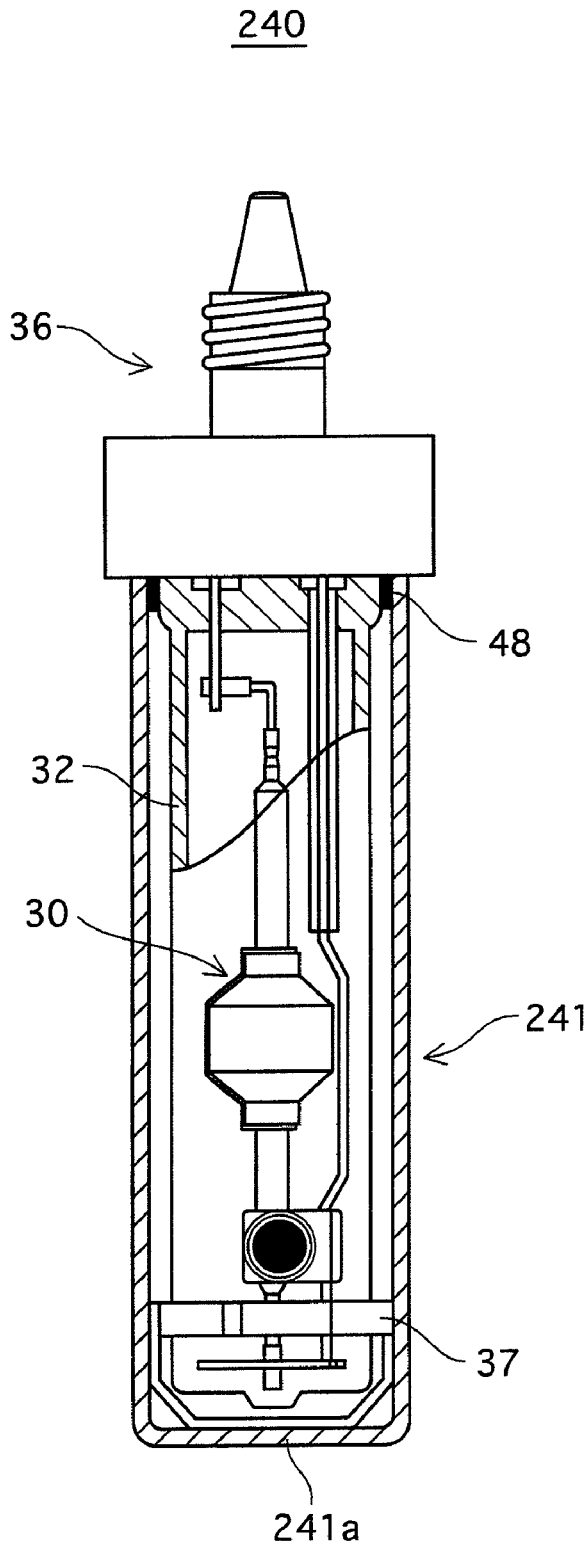
FIG. 27 is a partially cutout, elevational view of a lamp in accordance with a modification 17.

FIG. 27 is a partially cutout elevational view of a lamp 240 in accordance with a modification 17.

An outer tube 241 in accordance with the modification 17 is in a bottomed tubular shape having one open end (toward the base) and one closed end. The outer tube 241 is in a rectangular shape, seen in a direction orthogonal to an extension direction of the tube axis (tube axis direction) of the outer tube 241 (i.e. an elevational view). That is to say, another end 241*a* (an opposite end to the base 36) of the outer tube 241 is in a flat shape.

a2. Modification 18

Figure 28:
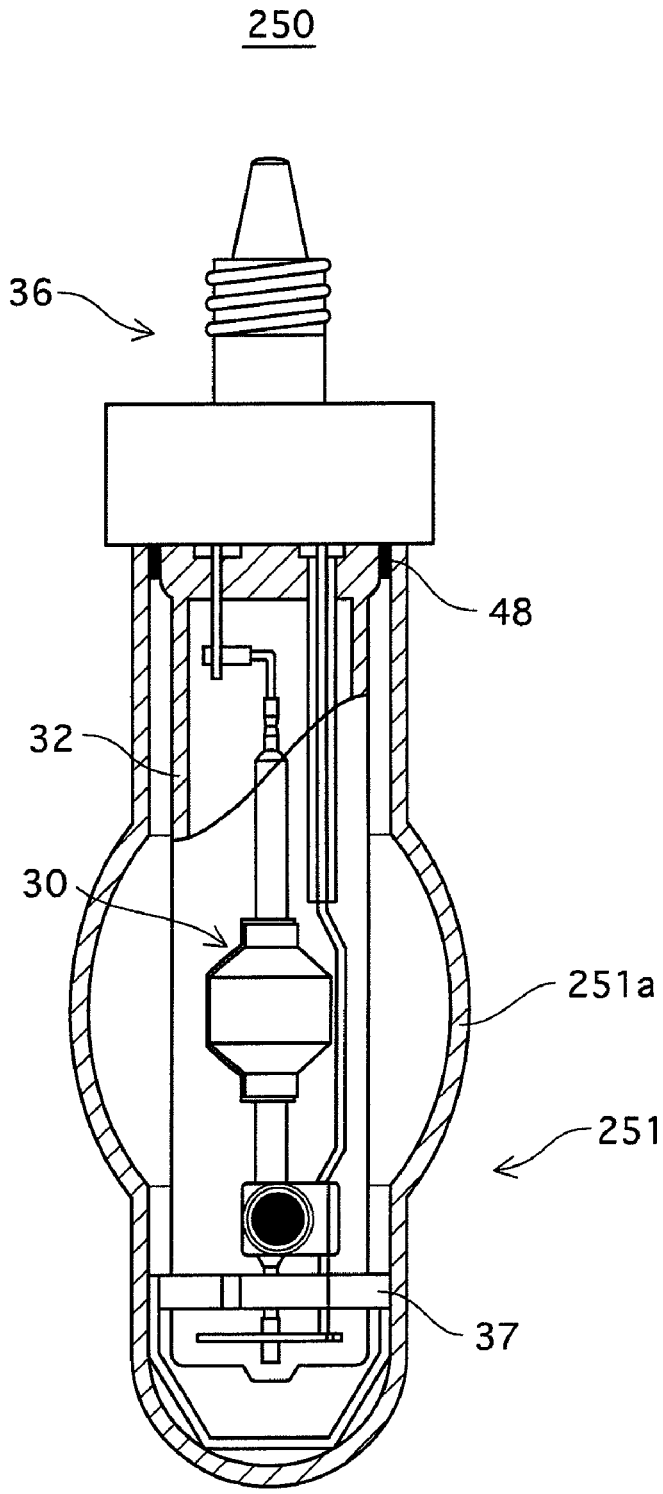
FIG. 28 is a partially cutout, elevational view of a lamp in accordance with a modification 18.

FIG. 28 is a partially cutout elevational view of a lamp 250 in accordance with a modification 18.

The outer tubes 34 and 241 in accordance with the embodiment and the modification 17 are each in a bottomed tubular shape having one open end (toward the base) and one closed end, and the tubular shape is a straight tube shape. On the other hand, as shown in FIG. 28, an overall shape of an outer tube 251 in accordance with the modification 18 is in a bottomed tubular shape having one open end (toward the base) and one closed end, and the outer tube 251 has swollen part 251*a* at the center of the tube axis of the tube part.

In a vertical section of the outer tube 251, a shape of the swollen part 251*a* is externally swollen in an arc. However, the swollen part 251*a* may be swollen in a different shape, such as a multangular shape including a triangle, a trapezoidal shape and the like. Note that the overall shape of the outer tube is in a three-dimensional shape formed by rotating the vertical section of the outer tube 251 about the axis direction of the outer tube 251.

a3. Modification 19

Figure 29:
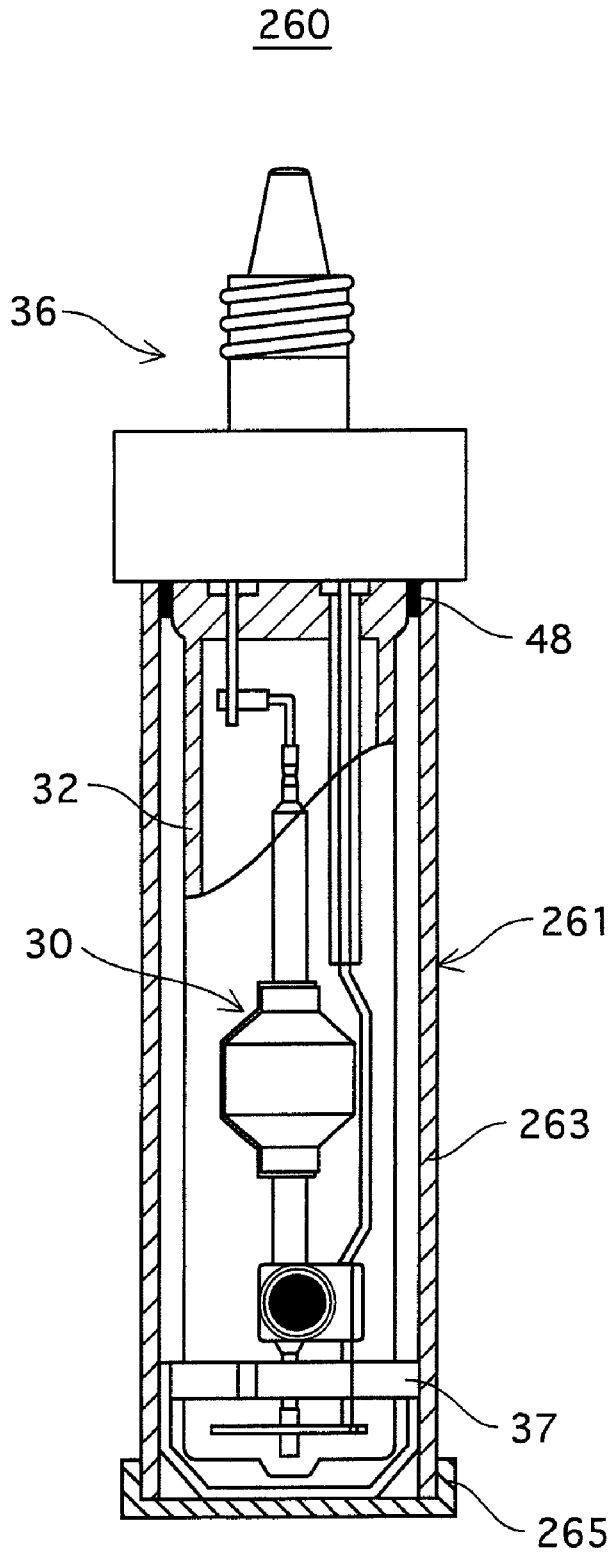
FIG. 29 is a partially cutout, elevational view of a lamp in accordance with a modification 19.

FIG. 29 is a partially cutout elevational view of a lamp 260 in accordance with a modification 19.

The outer tubes 34, 241, 251 in accordance with the embodiment and the modification 17-18 are each composed of a glass tube having one open end (toward the base) and one closed end. On the other hand, as shown in FIG. 29, an outer tube 261 in accordance with the modification 19 is composed of a tubular glass tube whose both ends are open.

That is to say, the outer tube 261 of the modification 19 includes a tube body 263 whose ends are both open and a covering body 265 that covers an end (an opposite end to the base 36) of the tube body 263. The covering body 265 may have any structure as long as the following can be achieved. When the inner tube 32 is broken due to breakage of the discharge tube 30 and the like, the broken pieces of the inner tube 32 and the discharge tube 30 are not to be scattered to the outside. For example, as shown in FIG. 29, a metal cap (e.g. made of stainless) may be used.

Note that the restrain member to control the alignment between the inner tube 32 and the outer tube 34 is not limited to the restrain member 37 of the embodiment. For example, the restrain member may be structured as shown in FIG. 30.

Figure 30:
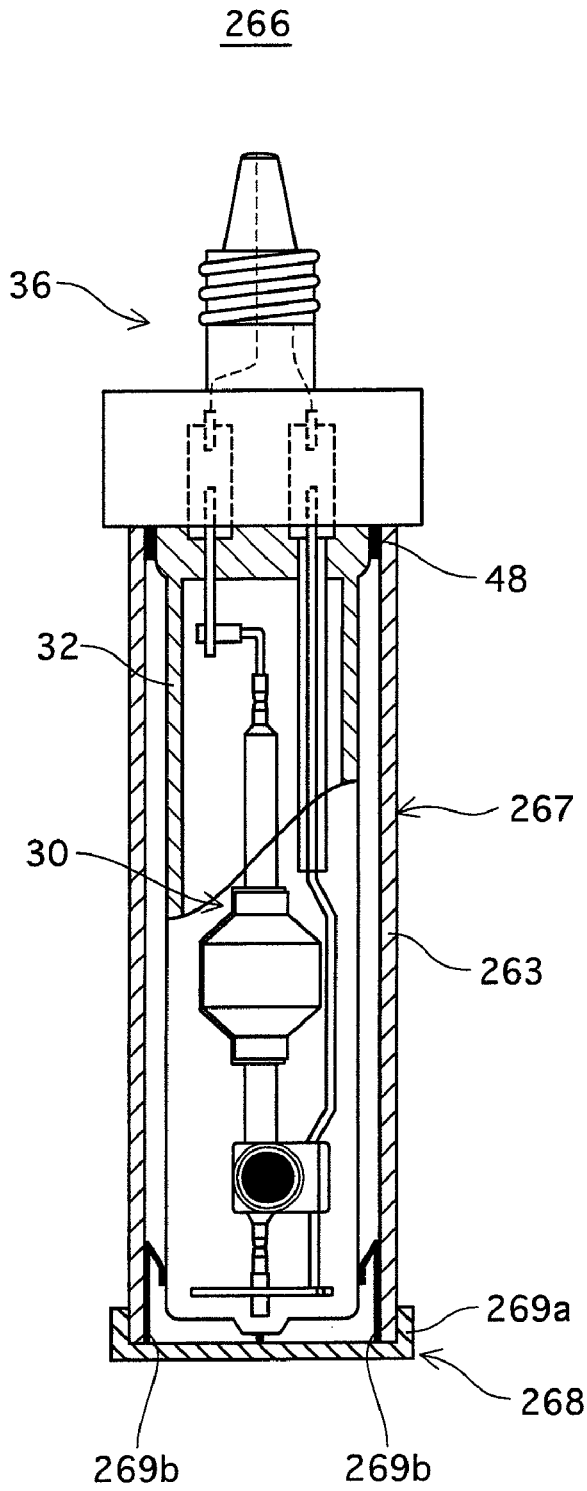
FIG. 30 is a partially cutout, elevational view of a lamp in accordance with a modification 20.

FIG. 30 is a partially cutout elevational view of a lamp 266 in accordance with a modification 20.

The outer tube 267 includes a tube body 263 whose ends are both open and a covering body that covers an end (an opposite end to the base 36) of the tube body 263. An example of the covering body is a metal cap 268.

The metal cap 268 includes a cap body 269*a* and restrain claws 269*b* formed on the bottom of the cap body 269*a*.

A plurality (four in this modification) of the restrain claws 269*b* are equally spaced in a circumferential direction along the outer circumference of the inner tube 32. The restrain claws 269*b* provided between the inner tube 32 and the outer tube 267 (tube body 263) each extend along the lamp axis. A top end of each of the restrain claws 269*b* is bent into a shape of the letter "V." The top end of each of the restrain claws 269*b* is deformed by the pressure caused by the insertion of the inner tube 32 into the outer tube 267, and the resilience of the deformation prevents the displacement of the inner tube 32 relative to the outer tube 267.

a4. Others

The outer tubes in accordance with the embodiment and the modifications 17, 19 and 20 are each in a straight shape, with their tube diameter roughly invariant. However, the outer tube may be in a shape whose tube diameter changes gradually or stepwise from the end near the base to a top end, such as a tapered shape.

b. Inner/Outer Surface

Although, the embodiment and the modifications do not especially describe the inner surface or outer surface of the outer tubes 34, 241, 251, 261 and 267, at least one of the inner surface (inner circumferential surface) and the outer surface (outer circumferential surface) of the outer tube of the present invention may be frosted. At least one of the inner surface and the outer surface may be entirely or partially frosted. In addition, the inner surface and the outer surface may be partially frosted. Note that frosting an opposite end (including the end) of the outer tube to the base serves glare prevention.

c. Glare Prevention

The embodiment and the modifications do not especially describe the glare prevention. However, the outer tube in accordance with the present invention may have a glare prevention member. More specifically, a metal cap having a plurality of through holes may be provided to cover the end of the outer tube (the end located in a direction in which light of the lamp is radiated from a reflecting mirror when the lamp mounted on a reflector is operated).

In this case, the shape and the structure of the outer tube covered with the metal cap are not especially limited. For example, the outer tube 34 of the embodiment, and the outer tubes 241 and 251 of the modifications 17 and 18 each of whose ends is closed at the end opposite to the base 36 are also applicable.

Note that if a plurality of through holes are provided in the metal cap of the modification 19, the metal cap (265) has a function of the glare prevention as well.

(3) Envelope

An envelope 46 that composes the discharge tube 30 of the embodiment is formed as follows. After the main tube part 40 and the thin tube parts 42 and 44 are formed separately, the thin tube parts 42 and 44 are joined to the main tube part 40 with use of shrink fitting (see FIG. 3). However, an envelope according to the present invention is not limited to that of the embodiment.

Instead of the main tube and the thin tube parts being formed separately, for example, the envelope may have a unitary structure that the main tube part and the two thin tube parts are integrally formed.

In addition, the envelope may be composed of two molded parts each of which is integrally formed by joining a half of the main tube part to the thin tube part. More specifically, a fitting part of the half of the main tube and that of another half of the main tube are fitted to each other. The half of the main tube part and the thin tube part that are fitted together may be integrally formed with use of shrink fitting, with the fitting parts being fitted to each other.

The envelope may be composed of a tube part (concretely a cylindrical part), a ring part and a thin tube part. The ring part is integrally formed with the tube part, being joined at each end of the tube part with use of shrink fitting. The thin tube part is integrally formed with one end thereof placed into a penetrating hole at the center of the ring part with use of shrink fitting. In this case, the envelope is of so-called a cylindrical type.

(4) Base a. Connection Type

As shown in FIG. 2, in the embodiment and the modifications 17-20, the base 36 of so-called Edison type of a screwed-type that has a shell 82 in a screwed shape and an eyelet 84 in a cone shape is employed. However, a base of another type may be used.

Figure 31:
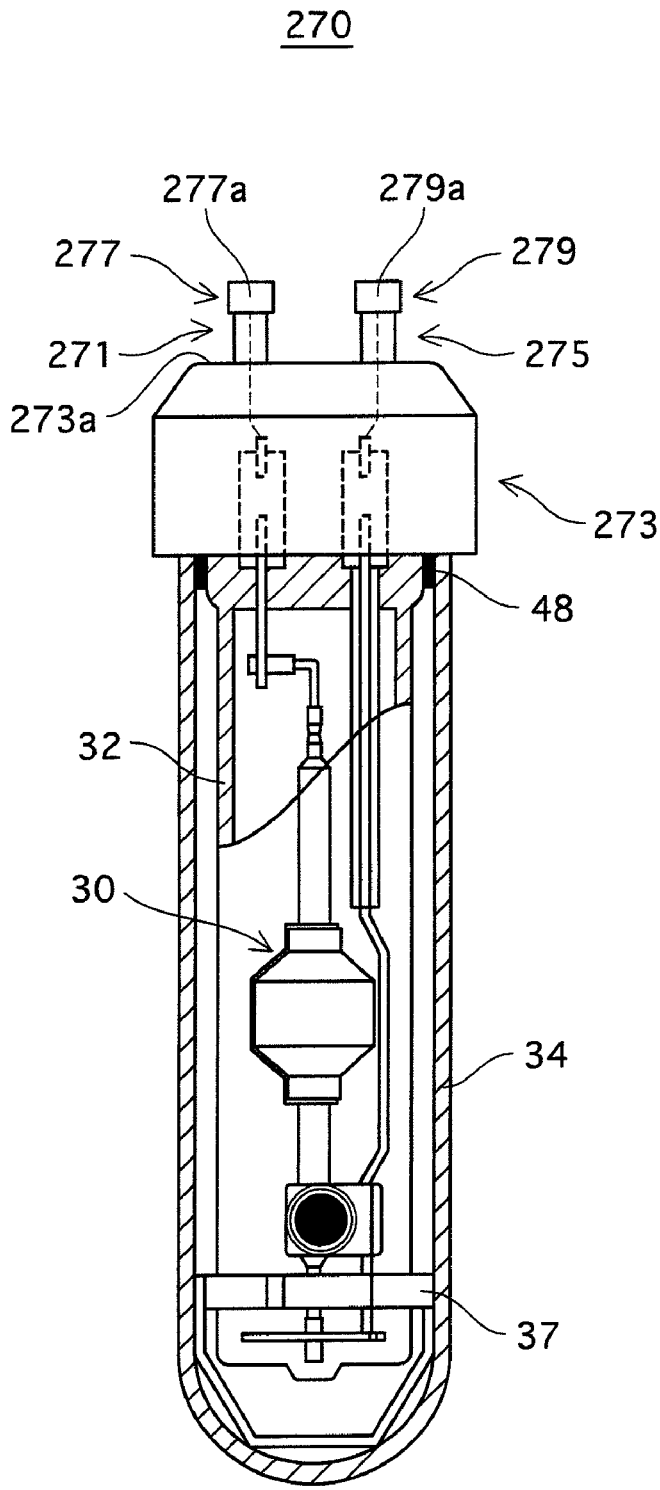
FIG. 31 is a partially cutout, elevational view of a lamp in accordance with a modification 21.

FIG. 31 is a partially cutout elevational view of a lamp 270 in accordance with a modification 21.

As shown in FIG. 31, a base 271 in accordance with the modification 21 includes a main body part 273 and a terminal part 275 disposed on a bottom 273*a* of the main body part 273.

The terminal part 275 includes a pair of pin terminals 277 and 279. Large diameter parts 277*a* and 279*a* may be disposed at the top ends of the pin terminals 277 and 279. This base 271 is of so-called Swan type.

As a matter of course, the base may have the main body part (273) in a bottomed tubular shape and a pair of the pin terminals (277, 279) each in a straight tube shape disposed at the bottom (273*a*) of the main body part (273). Such a base is of so-called G type or PG type.

b. Shape

The embodiment does not especially describe the base 36. As shown in FIG. 2, the bases 36 includes a main body part 36*a*, and a terminal part 36*b* disposed on the main body part 36*a*. The terminal part 36*b* is, for example, of Edison type. Note that the terminal part may be, for example, of Swan type, G type, PG type or the like.

The main body part (36*a*) in accordance with the embodiment and the modifications 6, 14 and 17-20 is in a bottomed tubular shape. Seen in a direction orthogonal to the central axis of the tubular shape (tube axis) (i.e. FIG. 2), the main body part (36*a*) is in a rectangular shape.

However, the shape of the main body part is not limited to the rectangular shape, and other shapes are also applicable.

Figure 32:
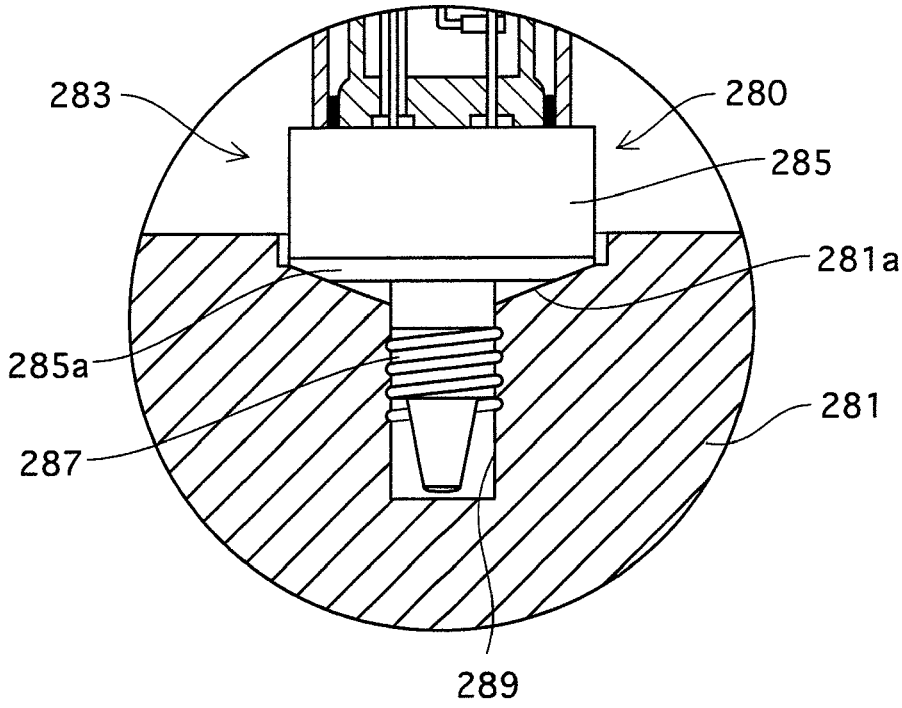
FIG. 32 is an enlarged view of a base when a lamp in accordance with a modification 22 is attached to a socket.

FIG. 32 is an enlarged view of a base when a lamp 280 in accordance with a modification 22 is attached to a socket 281.

A base 283 in accordance with the modification 22 has a different shape from the base 36 of the embodiment. That is to say, the base 283 of the modification 22 has a main body part 285 and a terminal part 287. The terminal part 287 is that of Edison type, and is screwed into a connecting hole 289 of the socket 281.

As shown in FIG. 32, a bottom of the main body part 285 tapered toward the terminal part 287 is a tapered part 285*a*. Note that the socket 281 also has a tapered part 281*a* that is a counterpart of the tapered part 285*a* and in contact with the tapered part 285*a*.

As described above, the tapered part 285*a* of the main body part 285 of the base 283 pairs up with the tapered part 281*a* of the socket 281, which prevents a lamp of a different specification from being mounted to the socket 281 (so-called improper use). In other words, if an attempt is made to insert a terminal part (287) of a base (283) of a different specification to a connecting hole (289) of the socket (281), the shape of the bottom of the main body part (283) does not match the shape of the connecting hole (289) of the socket (281). As a result, an eyelet of the terminal part (287) does not reach the position that is electrically connected with the socket (281).

Figure 33:
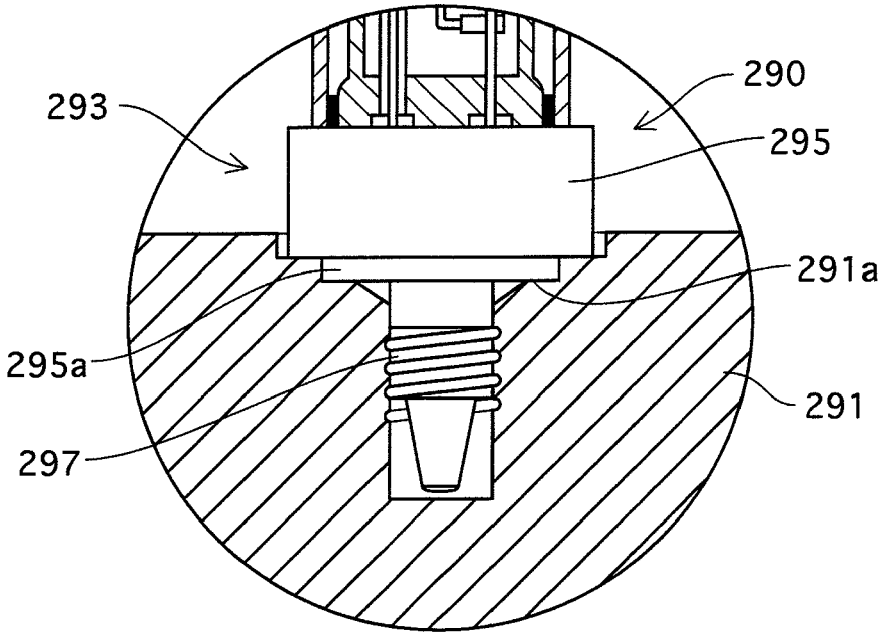
FIG. 33 is an enlarged view of a base when a lamp in accordance with a modification 23 is attached to a socket.

FIG. 33 is an enlarged view of a base when a lamp 290 in accordance with a modification 23 is attached to a socket 291.

A base 293 in accordance with the modification 23 has a main body part 295 and a terminal part 297, as with the base 283 of the modification 22. While the base 283 of the modification 22 has the tapered part 285*a* in the main body part 285, the base 293 of the modification 23 has a stepped part 295*a* in the main body part 295. Needless to say, the socket 291 has a stepped part 291*a* that is fitted with the stepped part 295*a* of the main body part 295 of the modification 23. The stepper part 291*a* pairs up with the stepped part 295*a*.

The base 293 of the modification 23 having the stepped part 295*a* can prevent the improper use of the lamp as described in the modification 22.

Note that in the modifications 22 and 23, the terminal parts 287 and 297 are of Edison type. However, terminal parts may also be of Swan type, G type, PG type and such. Such bases can also prevent the improper use of the lamp.

Note that the sockets 281 and 291 shown in FIGS. 32 and 33 are illustrated to show the relation of attachment and connection to the bases 283 and 293, respectively, and that their structures and the shapes are different from those of a real socket.

(5) Connection Between Inner Tube and Base

In the embodiment, the adhesive 48 is used to bond the inner tube 32 and the base 36. However, other methods may be used for bonding. The following describes a modification 24 where other method is used to bond the inner tube housing the discharge tube and the base.

Figure 34:
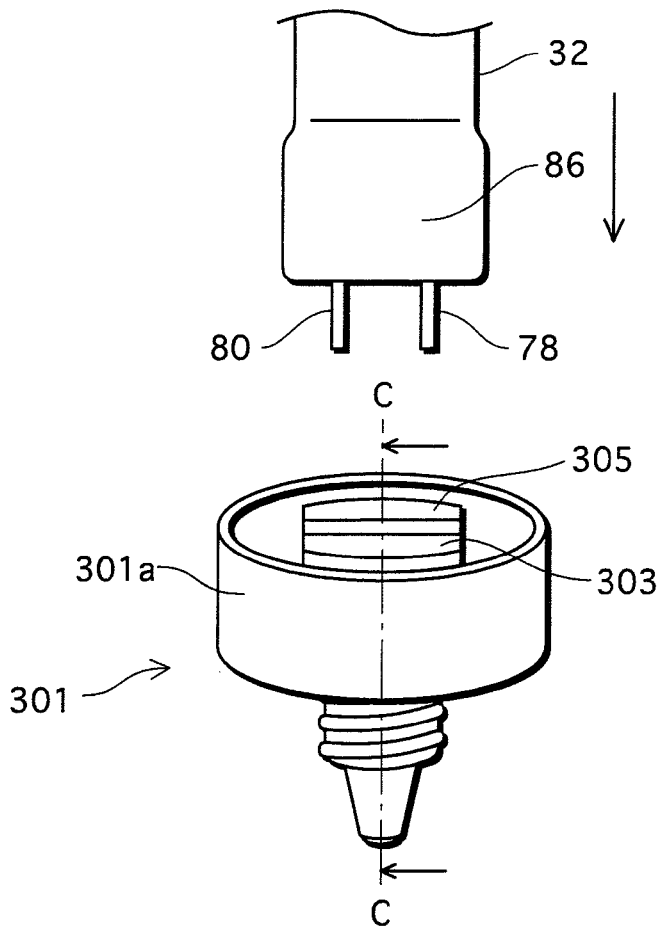
FIG. 34 is a view showing a connection between an inner tube and a base in accordance with a modification 24.
Figure 35:
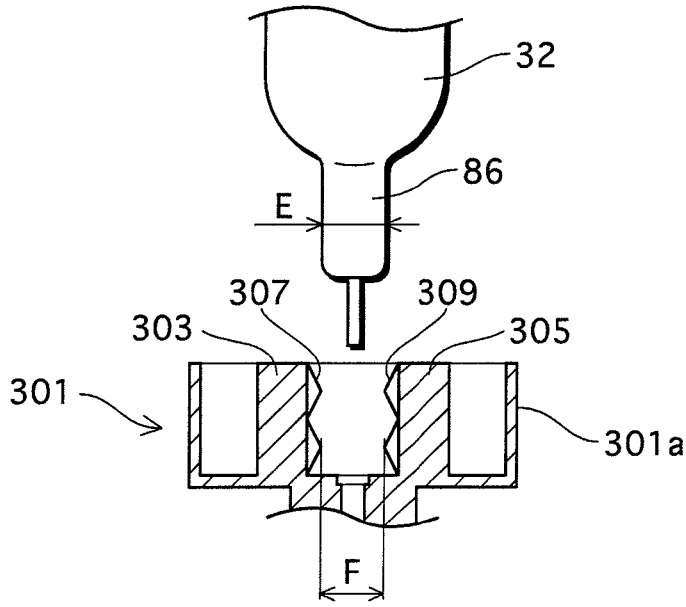
FIG. 35 is a sectional view taken along a line C-C, seen in an arrow direction shown in FIG. 34.

FIG. 34 is a view showing bonding between the inner tube 32 and a base 301. FIG. 35 is a sectional view of the base taken along the line C-C shown in FIG. 14, viewed in the arrow direction.

The inner tube 32 of the modification 24 has a similar structure with that of the embodiment. Therefore, the same reference numeral 32 is used for the inner tube of the modification 24. The inner tube 32 has a sealing part at an end thereof. The sealing part is sealed to hermitically house the discharge tube 30 within the inner tube 32. Here, as with the embodiment, the sealing part is a pinch-sealed part 86 that is pinched flatly with use of pinch-sealing.

As shown in FIGS. 34 and 35, the base 301 has a pair of supporting parts 303 and 305 inside the main body part 301*a*. An interval between the pair of the supporting parts 303 and 305 is larger than a thickness E (a size measured in a direction of the pinch sealing) of the pinch-sealed part 86 of the inner tube 32. Elastic members 307 and 309 are provided between the pair of the supporting parts 303 and 305. On the condition that the elastic members 307 and 309 are provided between the pair of the supporting parts 303 and 305, an interval F (see FIG. 15) formed between the supporting parts 303 and 305 (the elastic members 307 and 309) is smaller than the thickness E of the pinch-sealed part The inner tube 32 and the base 301 are connected by the pinch-sealed part 86 of the inner tube 32 being inserted between the pair of the supporting parts 303 and 305 of the base 301. That is to say, when the pinch-sealed part 86 is inserted between the supporting parts 303 and 305, the elastic members 307 and 309 are deformed. Then, memory of this deformation supports the pinch-sealed part 86. Accordingly, the inner tube 32 is fixed to the base 301 without using an adhesive.

More specifically, as shown in FIG. 35, the elastic members 307 and 309 are made of metal, and the shapes of their vertical sections are dogleg (a zigzag having a "W" shape rotated for 90 degrees). With this structure, a thickness (size measured in a direction orthogonal to the direction of the insertion of the pinch-sealed part 86) of each of the elastic members 307 and 309 is changed according to the insertion of the pinch-sealed part 86 that deforms the elastic members 307 and 309. Thus, the thickness (height) of the zigzag is changed.

Note that the elastic members disposed between the supporting members 303 and 305 are deformed by the insertion of the end (pinch-sealed part) of the inner tube, and as long as this deformation secures the end (pinch-sealed part) of the inner tube, any shape, quantity, material and the like are applicable.

For example, although the elastic members 305 and 307 of the modification 24 are each in a zigzag shape, other shapes are also applicable. As long as the inner tube (pinched-seal part) can be fixed, there may be only one elastic member disposed between the supporting parts. The elastic members may be made of a metal material, such as stainless or other metal materials. Note that the deformation caused by the insertion of the end of the inner tube depends on the material, the thickness, and such of the elastic members.

Figure 36:
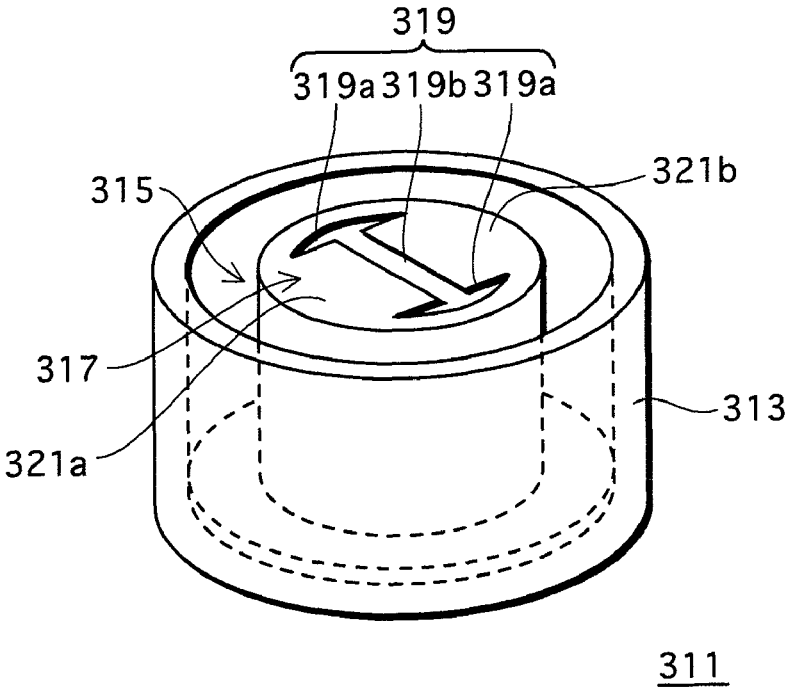
FIG. 36 is a perspective view of a main body part of a base in accordance with a modification 25.
Figure 37:
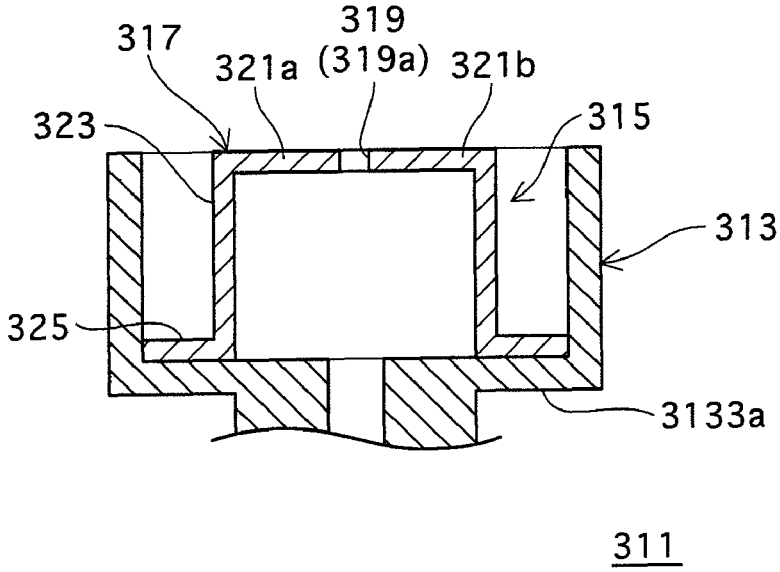
FIG. 37 is a vertical section of the main body part in accordance with the modification 25.

FIG. 36 is a perspective view of a main body part 313 of a base 311 in accordance with a modification 25. FIG. 37 is a vertical section of the main body part 313.

The base 311 is provided with a supporting member 315 that supports an inner tube at a base part 313*a* (corresponding to a bottom) of the main body part 313. The supporting member 315 is in a bottomed tubular shape, having an end wall 317 on which a through hole 319 is formed. The supporting member 315 is made of, for example, a metal. Parts of the end wall 317 are tongue pieces 321*a* and 321*b* that are deformed according to the insertion of the end of the inner tube. The through hole 319 into which the inner tube is inserted allows the tongue pieces 321*a* and 321*b* to be deformed.

As shown in FIG. 37, the through hole 319 is composed of a pair of parallel holes 319*a* and 319*a* that are parallel to each other in a given direction, and a connection hole 319*b* that connects approximately the center of the pair of the parallel holes 319*a* and 319*a*. The entire shape of the through hole 319 is approximately the letter "H." Both parts sandwiching the connection hole 319*b* are the tongue pieces 321*a* and 321*b*.

The supporting member 315 is obtained by drawing a metal plate of a given thickness. The metal plate is as thick as the following degree. When the inner tube is inserted into the through hole 319, the tongue pieces 321*a* and 321*b* are bent in the direction of the insertion.

Note that the supporting member 315 has a flange part 325 at an opposite end to an end wall 317 of a tube part 323. This flange part 325 is fixed to, for example, the base part 313*a* of the main body part 313 of the base 311.

The tongue pieces 321*a* and 321*b* of the supporting member 315 is deformed according to the insertion of the end (pinch-sealed part) of the inner tube. As long as the deformation serves to fix the inner tube, any shape, material, and the like are applicable.

More specifically, although the shape of the through hole that determines the shape of the tongue piece is in the alphabetical letter "H," the shape may be the Chinese character "" that that looks as if two converted letters "H" are stacked. In such a case, the total number of the tongue pieces is four. Also, there may be two tongue pieces that oppose each other, and the shape of each tongue piece may be the converted letter "T" or the letter "U" meshing each other.

Furthermore, the shape and the like of the supporting member 315 are not especially limited. The base may have the supporting member 315 and the main body part 313 of the modification 17 that are integrally formed.

(6) Connection Between Outer Tube and Base

In the embodiment, the main body part 36*a* of the base 36 is in a bottomed tubular shape. In a state where the end of the outer tube 34 is inserted into the main body part 36*a*, the outer circumference of the end of the outer tube 34 and the inner circumference of the main body part 36*a* are bonded with the adhesive 48 (e.g. cement). However, other shapes of the outer tube and the base are also applicable. The following modifications describe different shapes of the outer tube and the base that are connected together from those of the embodiment and the modifications 1-25.

a. Modification 26

Figure 38:
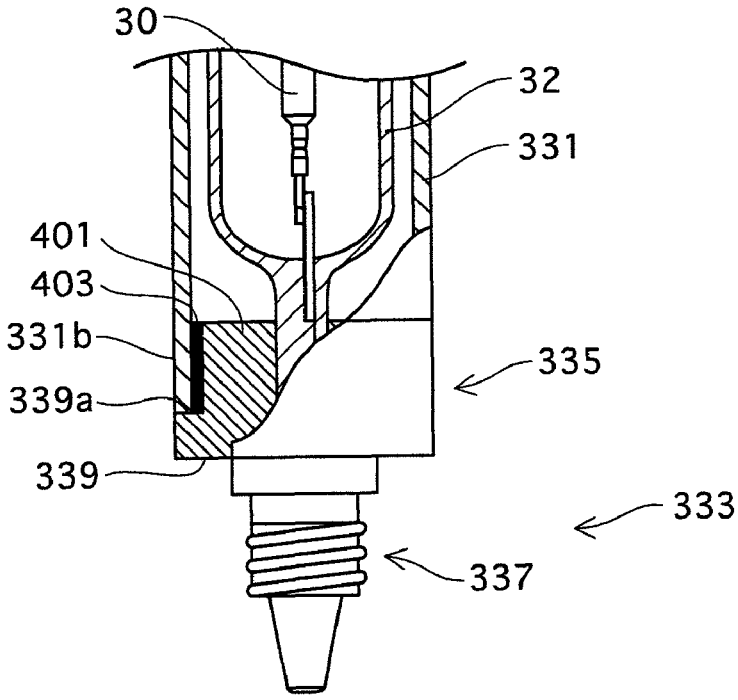
FIG. 38 is a view showing a connection between an outer tube and a base in accordance with a modification 26.

FIG. 38 is a view showing connection between an outer tube 331 and a base 333 in accordance with a modification 26.

The base 333 in accordance with the modification 26 has a main body part 335 and a terminal part 337.

The main body part 335 has a base part 339 in a discoidal shape and a supporting part 401 that is formed on approximately the center of the base part 339. When this main body part 335 is viewed in the axial direction of the outer tube 331, a distance between a fringe of the outer circumference of the base part 339 and the tube axis is larger than a distance between a fringe of the outer circumference of the supporting part 401 and the tube axis. A flat part 339*a* is formed between the two fringes.

The outer tube 331 and the base 333 are bonded as follows. In a state where an open end of the outer tube 331 is in contact with the flat part 339*a* of the base part 339, an inner surface of the open end part 331*a* of the outer tube 331 and an outer surface of the supporting part 401 are bonded together with an adhesive 403.

b. Modification 27

Figure 39:
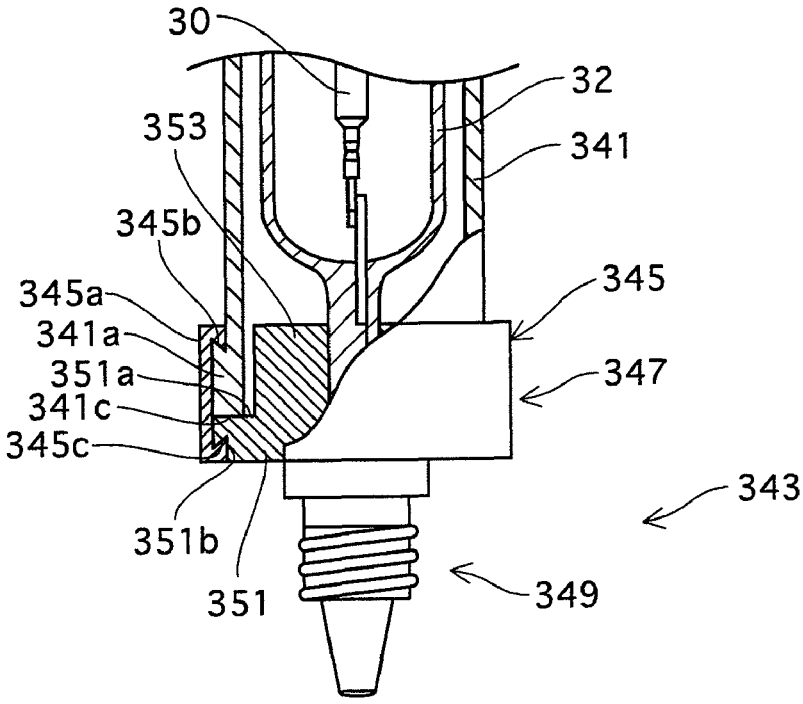
FIG. 39 is a view showing a connection between an outer tube and a base in accordance with a modification 27.

FIG. 39 is a view showing a connection between an outer tube 341 and a base 343 in accordance with a modification 27.

A lamp in accordance with the modification 27 has a structure to connect an outer tube 341 and a base 343 with use of a connecting member 345.

At an end of the outer tube 341 toward the base 343, a projection part 341*a* that projects outward is formed. This projection part 341*a* may comprise a plurality of the projection parts 341*a* placed along the whole circumference or placed at intervals in a circumferential direction of the end part of the outer tube 341.

The base 343 has a main body part 347 that supports an inner tube 32 and a terminal part 349 that is electrically connected with a socket.

The main body part 347 has a base part 351 in a discoidal shape and a supporting part 353 that is formed on approximately the center of the base part 351. When this main body part 347 is viewed in the axial direction of the outer tube 341, a distance between a fringe of the outer circumference of the base part 351 and the tube axis is larger than a distance between a fringe of the outer circumference of the supporting part 353 and the tube axis. A flat part 351*a* is formed between the two fringes.

As shown in FIG. 39, at an outer circumference of an end of the base part 351 of the main body part 347 opposite to the discharge tube 30, a depressed part 351*b* that is caved in is formed. Corresponding to the projection part 341*a*, the depressed part 351*b* may comprise a plurality of the depressed parts 351*b* placed in the whole circumference or placed at intervals in a circumferential direction of the end of the main body part 347.

The connection member 345 has a tube part 345*a* that is externally fitted over the projection part 341*a* of the outer tube 341 and the base part 351 of the base 343. At an end of the tube part 345*a*, an outer tube locking part 345*b* that is locked to an end of the projection part 341*a* (opposite end to the base) of the outer tube 341 is provided. On another end of the tube part 345*a*, a base locking part 345*c* that is locked to the depressed part 351*b* of the base part 351 of the base 349 is provided.

Corresponding to the projection part 341*a* of the outer tube 341 and the depressed part 351*b* of the base 343, a plurality of locking parts 345*b* and 345*c* of the connection member 345 may be provided in a whole circumference of each end or at intervals in the circumferential direction.

The outer tube 341 and the base 343 are connected as follows. In a state where the open end of the outer tube 341 is in contact with the flat part 351*a* of the base part 351, the outer tube locking part 345*b* of the connection member 345 is locked to the projection part 341*a* of the outer tube 341. Then, the base locking part 345*c* of the connection member 345 is locked to the depressed part 351*b* of the base 343.

Note that in the modification 27, the outer tube and the base are connected (locked) by the connection member (locking member). However, the outer tube may be connected (locked) to an integral part made of the base and the connection member. Also, the outer tube may be directly locked to the base.

3. Last

The restrain member is described in the embodiment and the modifications. However, unquestionably, the restrain member of the present invention may be any combination of the restrain members of the embodiment and the modifications, or any combination of the restrain members of the modifications.

Furthermore, any combination of each component disclosed in the above the embodiment or the modifications 1-27 is also applicable. For example, a lamp may be composed of the outer tube 251 of the modification 18 and a base that is a combination of the modifications 24 and 25. The combination is not limited.

INDUSTRIAL APPLICABILITY

The present invention is applicable to a metal vapor discharge lamp having a discharge tube, an inner tube and an outer tube and to a lighting fixture having the lamp for preventing displacement of the inner tube and the outer tube.

The invention claimed is:

1. A metal vapor discharge lamp comprising:

an outer tube;

an inner tube provided in the outer tube and fixed to a base by a sealed end of the inner tube;

a discharge tube provided with a pair of electrodes and housed in the inner tube, a power supplier electrically connected to the electrodes and housed in the inner tube; and a restrain member that restrains the inner tube from moving, and that is provided in a clearance between the inner tube and the outer tube, wherein the restrain member has an annular part that is extended in a direction orthogonal to a central axis of the inner tube and a supporting part that is extended from the annular part and that is approximately parallel to the central axis of the inner tube.

2. The metal vapor discharge lamp of claim 1, wherein the restrain member is circumferentially in contact with at least one of an inner circumferential surface of the outer tube and an outer circumferential surface of the inner tube at least at three points.

3. The metal vapor discharge lamp of claim 1, wherein the annular part is expandable in a radial direction of the inner tube, and the annular part that is expanded in the radial direction by the inner tube inserted therein is circumferentially in contact with an inner circumferential surface of the outer tube at least at three points.

4. The metal vapor discharge lamp of claim 1, wherein the end of the inner tube is connected with an end of the outer tube at an opening of the outer tube, the annular part has a first annular part and a second annular part each being fitted into the clearance forming an annular shape along an outer circumference of the inner tube, the first annular part is disposed at an opposite end of the outer tube to the end where the outer tube is connected to the inner tube, and the second annular part is disposed at the end where the outer tube is connected to the inner tube.

5. The metal vapor discharge lamp of claim 4, wherein the second annular part is fitted over the pinch-sealed end and is connected to the first annular part.

6. The metal vapor discharge lamp of claim 3, wherein the annular part is composed of a single plate-like member bent in an annular shape, and at least one end of the plate-like member is circumferentially movable along the annular part.

7. The metal vapor discharge lamp of claim 3, wherein the annular part has an elastic claw that is elastically deformable in a radial direction of the annular part.

8. The metal vapor discharge lamp of claim 3, wherein the annular part has a projection part that projects out toward the outer tube and/or the inner tube.

9. The metal vapor discharge lamp of claim 1, wherein the restrain member is disposed at least 5 mm away from a center of the discharge tube in an extension direction of a central axis of the discharge tube.

10. The metal vapor discharge lamp of claim 1, wherein the restrain member is composed of a material whose optical reflectance is 80[%] or more.

11. The metal vapor discharge lamp of claim 3, wherein the annular part is composed of a mesh material.

12. The metal vapor discharge lamp of claim 1, wherein the restrain member is composed of a transparent material.

13. A metal vapor discharge lamp including a discharge tube, an inner tube housing the discharge tube, and an outer tube having an open end and receiving the inner tube from the end, the outer tube being connected to the inner tube at the end, the metal vapor discharge lamp comprising:

a restrain member provided in a clearance between the inner tube and the outer tube, wherein the restrain member has an annular part and an elastic claw that is elastically deformable in a radial direction of the annular part.

14. The metal vapor discharge lamp of claim 13, wherein the annular part is composed of a single plate-like member expanded in a direction perpendicular to a central axis of the inner tube.

15. The metal vapor discharge lamp of claim 13, wherein the elastic claw is configured to press against an inner circumferential surface of the outer tube.

16. The metal vapor discharge lamp of claim 13, wherein the elastic claw is provided at three or more locations circumferentially along the annular part.

17. The metal vapor discharge lamp of claim 13 wherein the restrain member is composed of a material whose optical reflectance is 80% or more.

18. A lighting fixture having a metal vapor discharge lamp and a reflector that reflects, in a desired direction, light emitted from the lamp, wherein the metal vapor discharge lamp is a metal vapor discharge lamp as defined in claim 1.

19. A lighting fixture having a metal vapor discharge lamp and a reflector that reflects, in a desired direction, light emitted from the lamp, wherein the metal vapor discharge lamp is a metal vapor discharge lamp as defined in claim 13.

* * * * *